United States Patent [19]

Yanagimoto et al.

[11] Patent Number: 5,052,469

[45] Date of Patent: Oct. 1, 1991

[54] METHOD FOR CONTINUOUS CASTING OF A HOLLOW METALLIC INGOT AND APPARATUS THEREFOR

[75] Inventors: Shigeru Yanagimoto, Kitakata; Kazuyuki Hamachi, Chiba, both of Japan

[73] Assignee: Showa Denko Kabushiki Kaisha, Tokyo, Japan

[21] Appl. No.: 554,114

[22] Filed: Jul. 18, 1990

Related U.S. Application Data

[63] Continuation of Ser. No. 246,839, Sep. 20, 1988, abandoned.

[51] Int. Cl.[5] ..... B22D 11/00; B22D 11/08

[52] U.S. Cl. ..... 164/465; 164/415; 164/421; 164/444; 164/464; 164/475; 164/483

[58] Field of Search ..... 164/415, 421, 425, 445, 164/464, 465, 475, 483

[56] References Cited

U.S. PATENT DOCUMENTS

| | | | |
|---|---|---|---|
| 3,623,534 | 11/1971 | Brennan | 164/483 |
| 4,126,175 | 11/1978 | Getselev . | |
| 4,157,728 | 6/1979 | Mitamura et al. . | |
| 4,205,716 | 6/1980 | Nakahira et al. . | |
| 4,598,763 | 7/1986 | Wagstaff et al. | 164/444 |
| 4,719,959 | 1/1988 | Nawata et al. | 164/421 |

FOREIGN PATENT DOCUMENTS

| | | | |
|---|---|---|---|
| B-62946/86 | 3/1987 | Australia . | |
| 645175 | 7/1962 | Canada . | |
| 0293601 | 12/1988 | European Pat. Off. | 164/465 |
| 51-95931 | 8/1976 | Japan | 164/445 |
| 56-141944 | 11/1981 | Japan . | |
| 57-127548 | 8/1982 | Japan . | |
| 57-181759 | 11/1982 | Japan . | |
| 61-195757 | 8/1986 | Japan | 164/483 |
| 62-89549 | 4/1987 | Japan | 164/465 |

*Primary Examiner*—Richard K. Seidel
*Assistant Examiner*—Rex E. Pelto
*Attorney, Agent, or Firm*—Armstrong, Nikaido, Marmelstein, Kubovcik & Murray

[57] ABSTRACT

In a continuous casting a hollow ingot by means of a forcedly cooled tubular mold and a core, gas is introduced around an outer peripheral surface of the core along longitudinal slits to form an annular gap surrounding an inner peripheral surface of hollow metallic molten metal, and gas pressure is applied on said inner peripheral surface of the hollow molten metal. Refractory heat-insulative material, starter bar, is brought into contact with the molten metal poured into said annular space at the casting start, encased in the metal solidified thereon, and withdrawn together with the hollow ingot being withdrawn. By these methods smooth cast skin is formed on the inner peripheral surface of a hollow ingot.

7 Claims, 24 Drawing Sheets

METHOD FOR CONTINUOUS CASTING OF A HOLLOW METALLIC INGOT AND APPARATUS THEREFOR

This application is a continuation of application Ser. No. 246,839 filed 9/20/88 now abandoned.

BACKGROUND OF INVENTION

1. Field of Invention

The present invention relates to a method for the continuous casting of a hollow metallic ingot and an apparatus therefor. More particularly, the present invention relates to a method and apparatus for the continuous casting of a hollow ingot having a smooth cast skin on the inner peripheral surface and a small inverse segregation-layer.

The present invention also relates to a casting-start method in the continuous casting of a hollow ingot, in which the following troubles, which occur at the beginning of casting of a hollow ingot, are prevented: the core is encased in the cast metal; solidified thereon; and, the molten metal flows out through an inner peripheral part of the hollow ingot.

2. Description of Related Arts

A metallic tube and a long hollow material are used as the final products in their forms. Besides, a metallic tube and long hollow material are indispensable as blank materials of various annular or tubular members, such as wheel rims of vehicles, cylinders of compressors and the like. This blank material is produced by a die-extrusion method of a columnar metallic ingot, a continuous casting method, or a centrifugal casting method. The continuous casting method provides, at a low cost, a hollow ingot, having homogenous and fine casting structure free of a texture generating a directional property. The continuous casting method is therefore appropriate for producing the blank material which is subjected to plastic working, such as or ring-rolling or forging.

The continuous casting of a hollow ingot is generally carried out as follows. A core or a mandrel (hereinafter collectively referred to as the core) is concentrically held within a forcedly cooled, tubular mold to form an annular clearance between the mold and core, and the molten metal is continuously poured into the annular clearance. A solidified shell is formed around the hollow metallic metal in the mold. The solidification then proceeds toward the interior of the ingot, while it issues outside the mold and is directly sprayed by cooling water. The thus formed hollow ingot is withdrawn outside the mold at a controlled casting speed. The above described continuous casting method is generally embodied as: the so-called float casting method, in which a refractory floating member is disposed on the level of molten metal in a tubular mold so as to control the pouring quantity of molten metal; and, the so-called hot-top method, in which a relatively deep, refractory reservoir of molten metal is located integrally on the top of a forcedly cooled mold, and the level of molten metal in the reservoir is adjusted to the same level as that in the though for feeding molten metal to the reservoir. In a casting method without the aid of a mold, the molten metal is held in the columnar form by means of magnetic force and the columnar body is directly subjected to the water cooling to solidify the same. This method is implemented in a limited field of continuous casting. In the commercial casting, a multi-strand casting with a number of molds and the like arranged in parallel is carried out with regard to each of the above mentioned methods.

The above described continuous casting methods for a hollow ingot can be distinguished from one another from the view point of the following kinds of core: (A) refractory, non-cooled core; (B) forcedly cooled core; and (C) a core, in which an electromagnetic force is applied for shaping. Methods belonging to (A), above, are the floating method (1) and the float casting method (2). In the floating method (1), a gas-permeable core made of plaster is preliminarily shaped in an elongated form, molten metallic ingot is poured between the core and mold to form a hollow metal and to bond the metal with the core, and a solidified, long ingot is withdrawn outside the mold together with the bonded core, and subsequently the hollow metallic ingot and core are disassembled from one another (c.f. Japanese Examined Patent Publication No. 35-1106). In the float-casting method (2), a refractory core is made of material which is difficult to be wetted with molten metal and is maintained within a mold at a predetermined level (c.f. Japanese Examined Patent Publication No. 55-42655). Methods belonging to (B), above, are the following (3), (4) and (5). In the method (3) disclosed in Japanese Unexamined Patent Publication No. 57-127584, vibration is imparted to a core by means of an electromagnetic vibrator and the like during casting. In the method (4) disclosed in Japanese Unexamined Patent Publication No. 56-141944, a rotary core is used and is provided on the outer peripheral surface with a longitudinal slit for feeding lubricating oil on this surface. In the method (5) disclosed in Japanese Unexamined Patent Publication No. 57-181759, a refractory core used is provided with cooling conduits embedded therein. Methods belonging to the (C), above, are the following (6) disclosed in U.S. Pat. No. 4126175, in which an inductor disposed in a water-cooled mold generates electromagnetic force for forming the inner peripheral surface of molten metal and the ingot is brought into contact with neither the mold nor core but is directly water-cooled.

The qualities required for a hollow ingot, particularly one subjected to plastic working, such as forging, ring rolling, swaging and the like, are smooth cast skin of the inner peripheral surface and fine and homogenous structure with few inverse segregations. The additional qualities required for a hollow billet are roundness of the hollow part and uniformity in thickness of the round wall part of the billet. When these qualities are not fulfilled, a hollow billet needs to be subjected to machining for removing the inner peripheral surface layer, in large quantity. This necessitates and increase during casting in the thickness of the hollow ingot or the like by an amount corresponding to the destined machining depth. The machining cost is additionally required. A great amount of machined chips are lost during remelting thereof. Consequently, the cost increase incurred due to the above machining is serious. Furthermore, when the hollow part of a long ingot having a small-diameter is machined, the operation is so difficult that productivity is reduced.

The above described, conventional methods for continuously casting a hollow ingot have merits and demerits. It is difficult by means of these methods to industrially stably produce hollow ingots thoroughly fulfilling the above described properties. In methods (1) and (2), homogeneous structure is not obtained.

In addition, since the core of method (1) is consumable, the cost is disadvantageously increased. Since it is difficult to prevent the leakage of molten metal through the solidified shell at the side of the core, a stable operation is difficult in method (2). Method (3) is effective for reducing the engulfment of superficial oxide film. Leakage of molten metal through thin solidified shell is however likely to occur and, therefore, formation of smooth cast skin is difficult. In method (4), stable rotation of a core is difficult, since molten metal shrinks on the water-cooled core and exerts fastening force impeding the rotation of the core during solidification thereof. The rotary movement and lubrication are therefore not effective for forming smooth cast skin on the inner peripheral surface. In method (5), cooling conduits, through which air and the like are blown, are embedded in a core to control the temperature of the core. This method involves, as in methods (1) and (2), the drawbacks of leakage of molten metal at the core. Method (6) is effective for lessening the surface defects and inverse segregation of a hollow ingot but necessitates expensive installation expenditure for generating the electromagnetic field. In this method, the distance between multistrand molds are limited and the roundness of an ingot is impaired. Furthermore, since an inductor is assembled in the core, the space required therefore makes it difficult to reduce the size of the core. This method is therefore not applied for the production of ingots having a small-diameter hollow part.

When the continuous casting operation is to be started, a tubular water-cooled mold is closed at its withdrawal end by a movable bottom block which is capable of displacing in the casting direction. Molten metal is then continuously poured into the mold cavity formed between the tubular mold and core. The poured molten metal successively solidifies in the mold cavity and then forms a bonding part with the movable bottom block which has been placed at the beginning to close the withdrawal end of the mold cavity. Upon arrival at this condition, the movable bottom block is caused to displace so as to withdraw the hollow ingot. During withdrawal, the cooling water is injected onto the inner and outer peripheral surfaces of the hollow ingot to cool it. The spontaneous cooling of the hollow ingot without injection of cooling water may be occasionally carried out. Upon initiation of the above outlined start of casting, the tapping temperature of the molten metal, cooling water-flow rate in the mold and the like are monitored to estimate the solidification timing of molten metal on the movable bottom block. During the displacement of the movable bottom block, its speed is controlled in a delicate manner. For performing the sequence of start operations under the present circumstances, the skill of operator is indispensable. Although the casting start is carried out based on experience, such casting parameters as tapping temperature may vary beyond the criterion range. In this case, the molten metal solidifies due to drastic cooling by core and rigidly encases the core. Alternatively, when the cooling by the core is weak, the solidified shell is too thin to hold the molten metal therein. In this case, the molten metal may flow out of the solidified shell on the core. The continuation of the casting operation becomes difficult due to such trouble.

Incidentally, it is important for stabilizing the casting start and for providing smooth cast skin to provide the core with such a draft that diameter is great at the top part (inlet of metal flow) and is small at the bottom part. When metal solidifies and shrinks during the continuous withdrawal of an ingot, the friction resistance is caused between the outer peripheral surface of a core and the solidified shell or molten metal's surface destined to form the hollow surface. Since the solidification and shrinkage are intensified in the casting direction, the friction resistance is increased at a lower part of core. The draft of core can mitigate the friction resistance. With increase in draft, its effect becomes great but particular casting defects, i.e., lapping pattern or dropping pattern of unsolidified molten metal, become liable to form on the inner peripheral surface of a hollow ingot. When the draft is too small, the friction resistance is increased to a level where cracks are formed on the inner peripheral surface of a hollow ingot. Molten metal may leak through the cracks. The core may then be rigidly encased by the leaked molten metal, which makes the casting operation impossible. The draft of a core is therefore determined, depending upon the respective kinds of alloy and dimension of hollow ingots within an optimum range for attaining criterion qualities of cast skin.

The trouble of rigid core-encasement is most likely to occur in the case of using a forcedly cooled core, because the solidified shell rapidly grows on the forcedly cooled core during the initiation period of casting. Thickness and height of the solidified shell vary locally on the movable bottom block, because the cooling intensity of the molten metal varies depending upon the position in the mold cavity, such as inflow position and its opposite position. The casting parameters, such as the descending timing of the movable bottom block and the like, are therefore set within narrow ranges. It is very difficult to start the casting of a hollow ingot with a thin wall ranging from approximately 8 to 50 mm by means of a mold equipped with a forcedly cooled core. Meanwhile, heat conductivity of the heat-insulative core is dependent upon the material and dimensions of the particular core used. In the case of a graphite core, which is generally known core, the heat conductivity is high as compared with the refractory and heat-insulative core. When the graphite core is used at normal temperature, similar troubles as encountered in a forcedly cooled core, are liable to occur. The graphite core is therefore occasionally preheated before using. This preheating is not only very complicated in the mass production of hollow ingots but is extremely difficult to attain always constant range of temperature of cores at the casting start.

SUMMARY OF INVENTION

The present invention is made under the circumstances of casting hollow ingot as described above.

It is an object of the present invention to provide a continuous casting method which enables a stable and efficient production of a hollow ingot of particularly light metals, such as aluminum and magnesium, which has a smooth cast skin particularly on the inner peripheral surface, a homogeneous and fine structure with a small layer of inverse segregation, a high roundness, and a uniform thickness of wall.

It is another object of the present invention to provide an apparatus for implementing the method as described above.

It is a further object of the present invention to provide a method for eliminating the drawbacks encountered in the casting start of a hollow ingot, thereby providing a hollow ingot which is free of cast defects on the inner peripheral surface thereof and which has improved qualities.

The present inventors variously investigated methods for solving the problems involved in the continuous casting of a hollow ingot and discovered a method which can be applied to any one of the float method, hot-top method, or a direct tapping method with the aid of a spout.

The first invention of present application resides in a continuous casting method of a hollow ingot, comprising the steps of closing, at the casting start, an end of an annular space formed between a forcedly cooled tubular mold and a forcedly cooled core by a movable bottom block, continuously pouring molten metal into the annular space, holding the molten metal in the annular space, cooling and solidifying the molten metal by the tubular mold or. the tubular mold and core, thereby forming a hollow ingot, and continuously lowering the movable bottom block, thereby withdrawing the hollow ingot from the tubular mold, characterized by introducing gas around an outer peripheral surface of the core, forming, by said introduced gas, an annular gap surrounding an inner peripheral surface of a hollow molten metal held in the annular space, and applying gas pressure of the annular gap onto the inner peripheral surface of the hollow molten metal.

The second invention is an apparatus appropriate for carrying out the first invention and resides in a continuous casting apparatus of a hollow ingot comprising a forcedly cooled tubular mold and a core which is held inside the tubular mold, characterized by further comprising: an overhang which is formed on an outer peripheral surface of the core in contact with molten metal during casting and which uniformly and horizontally protrudes outwards of the core; and apertures which end on the outer peripheral surface of the core beneath the overhang and which are communicated with a gas source. The core used in the present invention may or may not be forcedly cooled. The hollow ingot, to which the present application is applied, is mainly a cylindrical hollow ingot, i.e., a hollow billet, which is blank material of various annular or tubular products. The present invention may also be applied to a hollow ingot having a square columnar form.

The gap, which is formed as a result of the pressure application, is positioned such that direct contact of molten metal with the core is impeded. The direct contact mentioned above is displaced downwards due to the formation of the gap. The annular gap in the case of a forcedly cooled core is by means of introducing pressured gas toward beneath the overhang and an overhang which is formed on the outer peripheral surface of the core in contact with molten metal during casting and which uniformly and horizontally protrudes outwards of the core. The annular gap in the case of a non-forcedly cooled core is an overhang of the core which is formed directly above an outer peripheral position of a core where the solidified shell starts to form and introduction of pressured gas toward beneath the overhang. The gas may be introduced through any passage provided that the gas is directed beneath the overhang. The apertures for introducing the gas are minute clearances or apertures which are so designed that molten metal does not invade therein. The apertures may be embodied in various structures. For example, in the hot-top casting method, a refractory and heat-insulative reservoir in the columnar or tubular form is located continuously on the top of a cooling core, and the lower peripheral surface of the overhang protrudes beyond the higher peripheral surface of the core to form an overhang. The slits for introducing gas are formed at the continuous parts and are communicated with passages of gas in the cooling core. According to another example, the apertures for introducing gas may be embodied as gas-permeable refractory material which constitutes the outer peripheral part of a core beneath the overhang and which is communicated with the passages for introducing of gas in the core. The refractory and heat-insulative reservoir mentioned above is preferably made of material which is difficult to be wetted with molten metal, such as the materials known under trade names of LUMIBOARD L100 (NICHIAS CO., LTD.), INSURAL (FOSECO Ltd.), and FIBERFLUX (TOSHIBA CERAMICS Co., Ltd.). The gas-permeable refractory material mentioned above is preferably one which has a high heat conductivity, and is difficult to be wetted with molten metal. Preferably, the pores of such material are such that molten metal is difficult to enter. Porous graphite, ceramics, e.g., silicon carbide bonded with porous silicon nitride, and refractory sintered metals are appropriate as the gas-permeable refractory material.

Gas introduced as described above is stored beneath the overhang of the top part of the cooling core and forms beneath the overhang an annular gap around the outer peripheral surface of core. The gap is therefore formed between the outer peripheral surface of the core and the inner peripheral surface of the molten metal. If the overhang is not provided, the gas introduced floats through the molten metal without stagnation and bubbles on the top level of the molten metal. The annular gap is therefore not formed.

The dimension of the of an overhang, i.e., the external protrusion of the outer peripheral surface of a forcedly cooled core, is preliminary determined by experiments and is dependent upon the kinds of metals and alloys, shape and dimension of the ingot, casting speed, height of the molten metal and mold, and the like. For example, in the case of the aluminum or magnesium based alloys and a hollow ingot having inner diameter of from 20 to 100 mm, the protrusion is 1.5 mm or more, preferably 3.0 mm or more. Less than this value, it is difficult to stably maintain the annular gap for gas application. The upper limit of protrusion is not specifically limited but a protrusion exceeding 15 mm is insignificant.

Pressure to be applied in the annular gap is in the vicinity of hydrostatic pressure of molten metal at the level of the annular gap, which is formed beneath the overhang. The pressure to be applied should be: below such a value that the gas overflows above the overhang and then floats to bubble on the level of molten metal; and, above such a value that the contact area of molten metal with the outer peripheral surface of the core is essentially reduced by the annular gap.

The annular gap formed as a result of gas introduction is not gas tight. Gas, which is in excess of that needed to form the annular gap, having a pressure nearly commensurate with the hydrostatic pressure mentioned above, flows downwards through minute clearances between the outer peripheral surface of the cooling core and the thin solidified shell around the metal body. During flowing the gas forms a curtain. It is presumed based on the experiments by the inventors that: the clearances mentioned above pulsate and their positions vary in the circumferential direction around the metal body; and, shrinkage of molten metal due to cooling causes expansion of the annular gap and expansion of the molten metal due to hydrostatic pressure causes the annular gaps to diminish; the annular gaps move along the core surface; and, every gap pulsates. Accordingly, when certain casting parameters are given, virtually a constant flow rate of gas needs to be kept so as to maintain the gap, where predetermined gas pressure is applied. Gases, which can be used for aluminum-base alloys, are argon, nitrogen, helium and the other inert gases. According to experiments by the present inventors, air, nitrogen, thermally decomposed gas of lubricating oil and alcohol, and steam unexpectedly bring about good results for a number of the above mentioned base alloys. These gases and vapors containing oxygen at a concentration of 80% by volume or less were discovered to be appropriate for light metals and their alloys. When the volume of oxygen exceeds 80%, combustion reaction of lubricating oil with oxygen takes place to impair the lubricating effect of the oil. In the case of continuous casting of aluminum-lithium alloys, the volume of oxygen should be 15% or less, since these alloys have high viscosity. Appropriate gases used for continuous casting of magnesium base alloys are argon, nitrogen, helium, carbon dioxide, and other inert gases, and sulfur hexafluoride, alone or in combination.

As in conventional continuous casting, a lubricating interface is formed on the outer peripheral surface of a cooling core so as to prevent sticking of molten metal on such a surface. The lubricating interface is formed by well-known methods, such as continuously or semi-continuously feeding liquid lubricating oil onto such surface to wet it, and forming a core out of material having heat resistance and a self-lubricating effect, such as graphite and boron nitride have.

In the present first and second inventions, the heat flow rate from the inner surface of the molten metal held in a hollow columnar form to the cooling core is decreased, and the friction between the core and the semi-solidified or solidified ingot is decreased. As a result, the cast skin of a hollow ingot is smooth at the inner peripheral surface, the inverse segregation layer is small in the metal structure at a region directly beneath the cast skin, and the structure is uniform throughout the inner and outer peripheral layers of the hollow ingot.

In a non-forcedly cooled core, predominant cooling factors that advance the solidification of molten metal held in a columnar form are the cooling by a forcedly cooled mold and the direct cooling (chilling) by cooling water injected onto the outer peripheral surface of a solidified ingot beneath the mold. The solidification interface of the molten metal has therefore a configuration like a slope which descends from the outer peripheral surface of molten metal toward the core. Increase in viscosity of molten metal occurs in the molten metal beside the core, because the proportion of solid phase to liquid phase increases in the outer peripheral surface of the molten metal until solidification is completed. This in turn causes increase in the friction between the molten metal and the outer peripheral surface of the core, thereby frequently generating various casting defects, such as cracks and streaks, and casting troubles, e.g., break out.

When the first and second inventions are applied to the non-forcedly cooled core, an annular gap is formed around the outer peripheral surface of the core and decreases the contact area between the outer peripheral surface of the core and the molten metal, particularly molten metal in the vicinity the solid-liquid interface. Friction is also decreased by a curtain of gas which flows down along the boundary between the solid ingot and the core. The present invention is therefore advantageous for the continuous casting with the aid of a non-forcedly cooled core and allows hollow ingots having a smooth cast skin around the inner peripheral surfaces to be produced without casting troubles, e.g., break out.

In accordance with an object of the present invention, there is provided a continuous casting method of a hollow ingot according to the first invention further comprising, when starting casting, the steps of: covering, before pouring the molten metal into the annular space, the inner peripheral surface of the cover with a refractory heat-insulative material, bringing the refractory heat insulative material into contact with the molten metal; pouring the molten metal into the annular space at the casting start; encasing the refractory heat-insulative material with cast metal being solidified on said refractory heat-insulative material; and, withdrawing, together with the refractory heat-insulative material, the hollow ingot. This method is referred to as the third invention. The third invention can be embodied as: the first embodiment, in which only the outer peripheral surface of a core is covered with a refractory heat-insulative ring; the second embodiment, in which the outer peripheral surface of the core and the forcedly cooled mold are covered with a refractory heat-insulative ring; and, the third embodiment, in which the outer peripheral surface of a core, the forcedly cooled mold, and the top surface of a movable bottom block are covered with refractory heat-insulative material. In the first embodiment, the outer peripheral surface of the core is covered with a refractory heat-insulative ring, so as to improve the thermal influence of the part of the core in contact with the molten metal and to retard growth of solidified shell on the outer peripheral surface of the core. In the second embodiment, not only the thermal influence of the core but also the thermal influence of the part of molten in contact part of mold with molten metal are improved. Namely, the inner surface of the forcedly cooled mold is covered with material which is refractory and heat-insulative. As a result, an oriented solidification is realized so that the solidification advances predominantly by cooling by a movable bottom block. In this embodiment, solidification of molten metal is retarded in the casting passage formed by the core, mold and bottom block. In the third embodiment, the thermal influence of a movable bottom block is also improved so as to realize heat-insulation state in the casting passage and hence to attain a stable casting-start of a hollow ingot with a thin wall.

The third invention can be embodied as the fourth embodiment. Namely, lugs made of material resistant against erosion by the molten metal are rigidly provided on the movable bottom block, in carrying out the first, second and third embodiments. Since the lugs are encased in cast metal being solidified thereon, and the movable bottom block is subsequently withdrawn, this embodiment furthermore stabilizes the casting start.

The refractory heat-insulative material used in the above embodiments of the third invention is selected from among various material shaving refractory and heat-insulative properties at the temperature of molten metal. For example, for molten metal of aluminum and its alloys, sheets made of various ceramic fiber or sheets which are formed by slip casting ceramics into a form of ring are used. Alumina fiber, silica fiber, glass fiber, carbon fiber, preformed LUMIBOARD (trade name of NICHIAS CO., LTD.), and the like are preferred as the ceramic fiber. As commercial products, Ceramics Paper (trade name of Toshiba Monoflux Co., Ltd.) and Ibiwool paper (trade name of Ibiden Co., Ltd.) are representative ceramic wools. These materials have a low heat conductivity, for example, 0.11–0.08 Kcal/mh° C. at 700–600° C. for Ibiwool paper (1 mm thick). Materials and their thickness are selected considering the kind of molten metal, temperature, heat capacity of the mold block as a whole, cooling condition, and the like Thickness of the refractory heat-insulative material is usually in the range of from 0.5 to 3 mm.

The refractory heat-insulative ring is preferably embodied as follows. That is, the ring is provided, on the surface brought into contact with the molten metal, with lugs made of material which is resistant against erosion by molten metal. The ring is provided, intermediate or top part, with holes which reach the core and/or mold. The ring is provided, on an intermediate part, with holes reaching the top surface of the movable bottom block. The lugs and holes mentioned above may be provided in combination. In these embodiments, the lugs and holes are rigidly engaged with the solidified metal at casting start, thereby allowing stable separation of refractory heat-insulative material from the outer peripheral surface of the core or the inner peripheral surface of the mold.

The lug(s) on the movable bottom block, which are appropriate in the fourth embodiment may be a single or plurality of nails or rods. Two or six nails or rods spaced at equal distance apart are usually satisfactory.

BRIEF DESCRIPTIONS OF DRAWINGS

FIG. 1 and FIGS. 2(A) and (B) show an apparatus of Example 1, in which the first invention is applied for the hot-top casting. FIG. 1 is an overall view. FIG. 2(A) is a cross sectional view of the essential parts of the core. FIG. 2(B) is a plan view of the core.

FIG. 23 illustrates an example, in which the refractory heat-insulative cover shown in, FIG. 22 is integrally formed.

Figure 31:
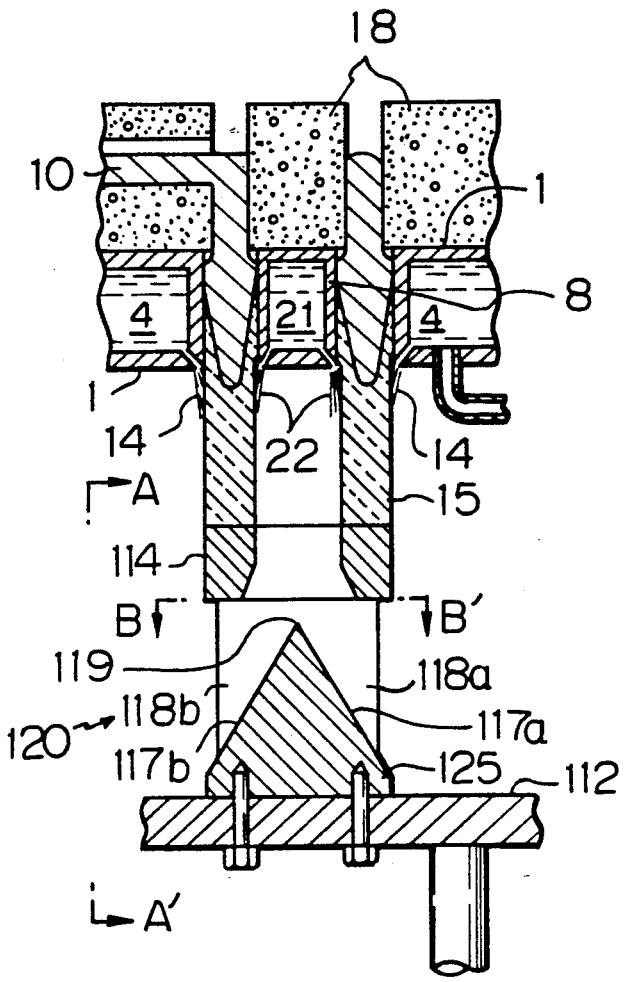
Figure 31:
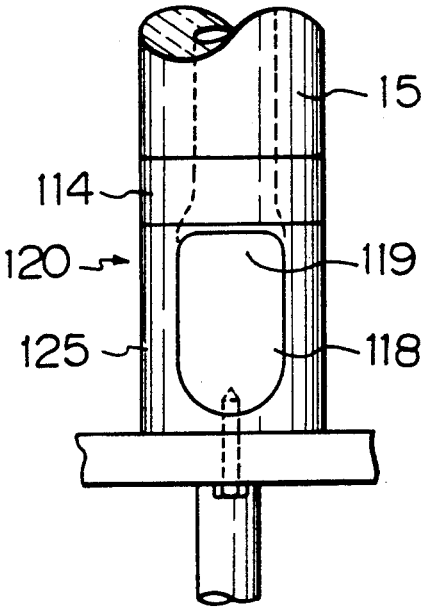
Figure 31:
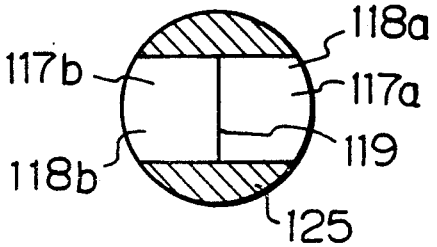

FIG. 31 shows a continuous casting apparatus according to an embodiment of the present invention, in which a movable bottom block includes two slopes therein, which slopes having arris lines. FIG. 31(A) is a vertical cross sectional drawing of a general view of the apparatus. FIG. 31(B) is a side view of the bottom block and a cross sectional view along line A—A'. FIG. 31(C) is a cross sectional view of the bottom block along the line B—B'.

Figure 32:
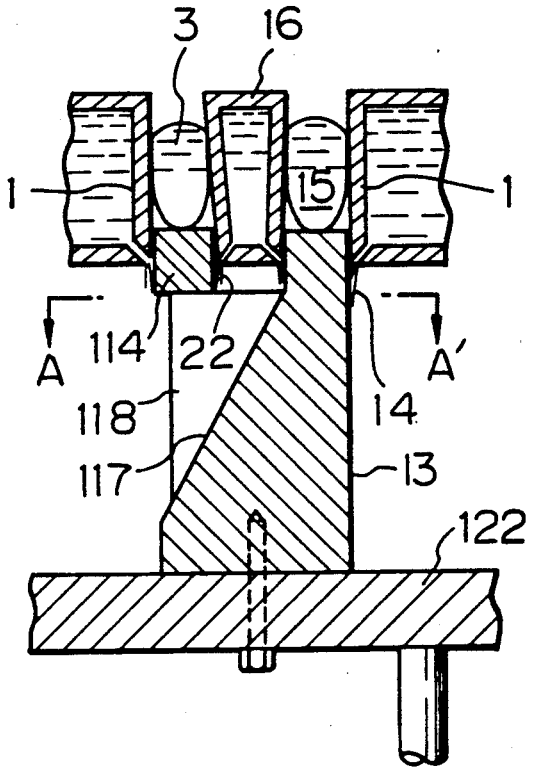
Figure 32:
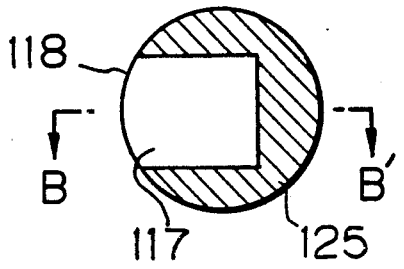

FIG. 32 shows a continuous casting apparatus according to an embodiment of the present invention, in which a movable bottom block includes one slope having arris line FIG. 32(A) is a vertical cross sectional drawing of a general view of the apparatus. FIG. 32(B) is a side view of the bottom block and a cross sectional view along line A—A'. FIG. 32(C) shows a cross sectional view of a bottom block along the line B—B'.

The present invention is hereinafter described with reference to the non-limitative embodiments.

Figure 1:
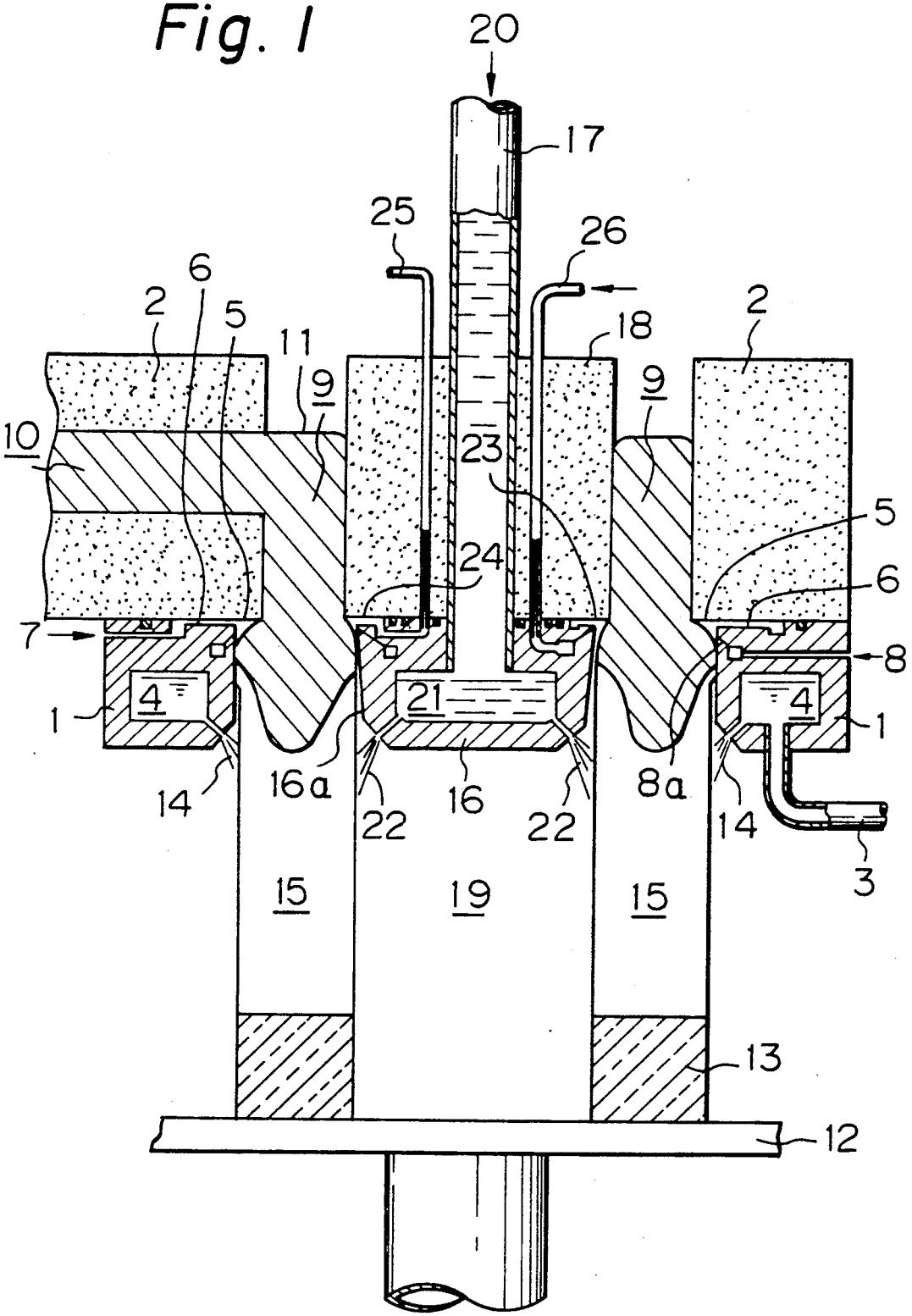

FIG. 1 is a drawing which illustrates an example of the first invention which is applied to the hot-top casting method. The illustrated apparatus can be summarized as follows. A hot-top continuous casting apparatus with the pressure application disclosed in U.S. Pat. No. 4157728 (West Germany Patent No. 2734388) is additionally provided with a core so as to carry out the first invention and to form smooth cast skin on both the inner and outer peripheral surfaces of a hollow ingot. A tubular mold 1 is made of material which is highly heat-conductive and heat-resistant, such as metal and graphite. The tubular mold 1 has an appropriate shape defining the outer peripheral surface of a hollow ingot 15 and surrounds the space where a hollow ingot 15 is formed. The tubular mold 1 has a traversally circular shape, when, for example, a cylindrical ingot is cast. The mold 1 has a cavity, into which the forcedly cooling media, such as water 4, flows though the water-feeding conduit 3. On the top surface of a tubular mold 1, a molten metal reservoir 2 made of refractory heat-insulative material (for example, trade name "LUMIBOARD") is rigidly connected. The molten metal reservoir 2 is located concentrically with respect to the tubular mold 1.

The peripheral surface of the lower end of the molten metal reservoir 2 uniformly protrudes beyond the inner surface of tubular mold 1 and hence forms an overhang 5. Minute slits 6 are formed at the contact area of the top surface of tubular mold 1 and bottom end surface of molten metal reservoir 2. The slits 6 are directed to the inside of the mole. Pressure gas is fed to the slits 6 from introduction port 7 and is then introduced beneath the overhang 5. Lubricating oil in liquid for is pressured and fed through an introduction port 8. Minute slits 8*a* for feeding the lubricating oil are formed in the tubular mold 1 and oriented toward the inner peripheral surface near the top end of the mole. The lubricating oil is therefore fed through the minute slits 8*a* and consequently flows over the inner peripheral surface of tubular mold 1.

Molten metal 9 is poured through the feeding port 10 into the molten metal reservoir 2, until the molten metal reaches the level 11. The molten metal 9 is brought into contact with and cooled by the peripheral surface of mold 1 which is cooled by water 4. The solidification of molten metal 9 thus starts. The gas introduced as described above flows in beneath the overhang 5 and forms there an annular gap, where gas pressure is applied. The starting point of solidification is forced to displace downwards due to the annular gap. The annular gap extends along the inner peripheral surface of the tubular mold 1, and the top and bottom ends of the annular gap are located directly beneath the overhang 5 and at a place somewhat distant from the overhang. The contact of the molten metal with the inner peripheral surface of the mold is impeded by the annular gap.

A movable bottom block 13 is placed on the table 12 which is supported by a hydraulic mechanism in a liftable manner. The solidified ingot 15 is lowered by means of the hydraulic mechanism and is subjected, during the lowering movement, to the direct action of secondary cooling water 14, 22 which is injected through the slits elongated through the lower end of mold and core and oriented downwards. When certain length of an ingot issues, the pouring of molten metal into the molten metal reservoir 2 and the lowering movement of table 12 are stopped, the tubular mold 1 is displaced away, and the table 12 is elevated to carry the ingot 15.

The core 16, which is forceably cooled, is held inside concentrically or coaxially with respect to the tubular mold 1 which is forcedly cooled. The core 16 is made of material which is the same as or similar to that of the tubular mold 1. The core 16 has an appropriate shape for defining the inner peripheral configuration of a hollow ingot 15. The shape of the core 16 is cylindrical, when, for example a round tubular ingot is to be cast. The core 16 occupies the space where the hollow part 19 of an ingot 15 is formed. The outer peripheral surface 16*a* of the core is tapered, as shown in the drawing, toward inside, commensurate with the solidification shrinkage of the molten metal. The core 16 is supported by a pipe 17 which is integrally attached to the axial center of core 16 and which extends vertically upwards. The pipe 17 is operably connected with the supporting mechanism (not shown). The mechanism supports the core 16 at a fixed position or supports the core 16 vertically movably. This mechanism controls the horizontal and vertical positions of the core 16. In the embodiment illustrated in FIG. 1, the top level of the core 16 is flush with the top level of the tubular mold 1. The top level of the core 16 can, however, be optionally selected higher or lower than the top level of the tubular mold 1, depending upon the kind of cast metals, dimensions of the hollow ingot, thermal equilibrium conditions of the continuous casting apparatus and the like.

Pipe 17 opens at its lower end to the cavity 21 of the core 16. Cooling water is fed from the upper end 20 of a pipe 17 and then cools the core 16. The cooling water is then injected through the slits or holes having a smaller diameter which are formed in a lower peripheral end of the core 16 and directed downwards. The thus injected water constitutes the secondary cooling water 22.

The header 18, which is made of cylindrical refractory heat-insulative material (trade name "LUMIBOARD"), is fixed on the top surface of the core 16 at a position concentrical to the core 16. The pipe 17 vertically protrudes the header 18. In the present embodiment, the material of the header is the same as that of molten metal reservoir 2. Their materials may however be different from one another. The outer peripheral lower surface of the header 18 uniformly protrudes beyond the outer peripheral upper surface of the core 16 and thus forms an overhang 23. Minute slits 24 are formed at the contact part of the top end of the core 16 and the bottom end of the header 18 and are directed outwards. The minute slits 24 have uniform dimensions around the contact part. Pressured gas is fed to the slits 24 through the introduction conduit 25 which protrudes through the header 18. Gas pressure is therefore applied toward the inner peripheral surface of the molten metal beneath the overhang 23. An introduction pipe 26 is also provided for feeding the lubricating oil therethrough. Minute apertures 26*a* (FIG. 2) are radially formed around the wall part of the core 16, and are directed to the outer peripheral surface of the core 16. The lubricating oil therefore exudes at the outer peripheral surface of the core 16 and consequently uniformly wets such surface.

Figure 2:
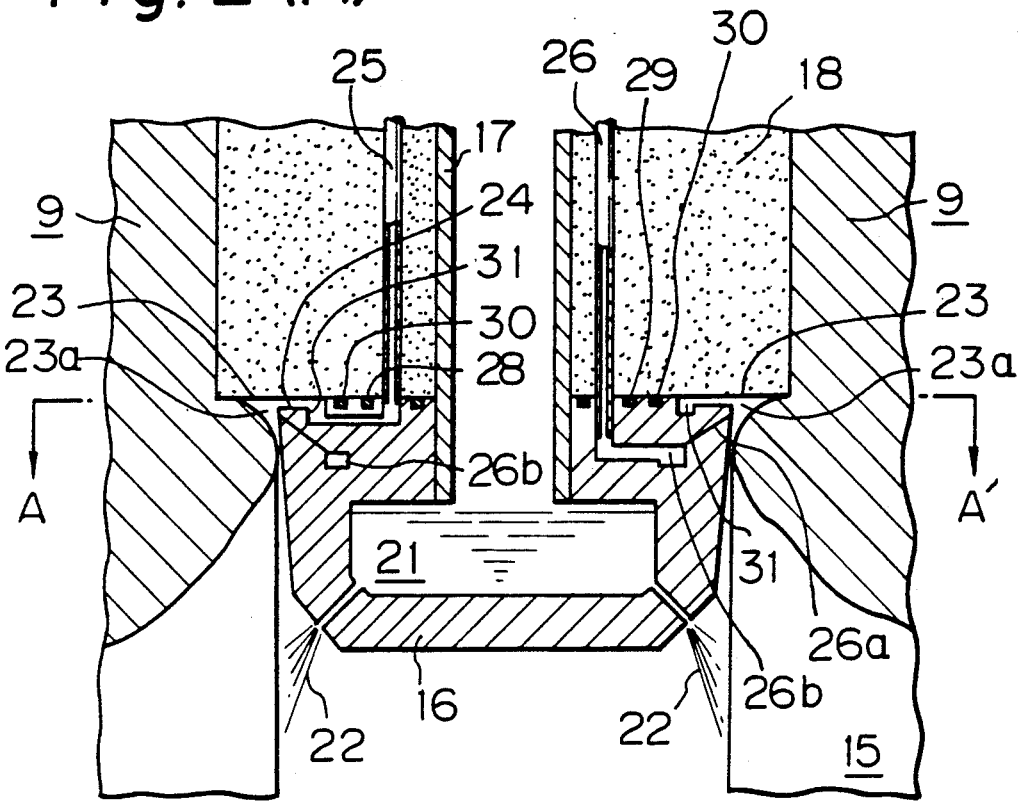
Figure 2:
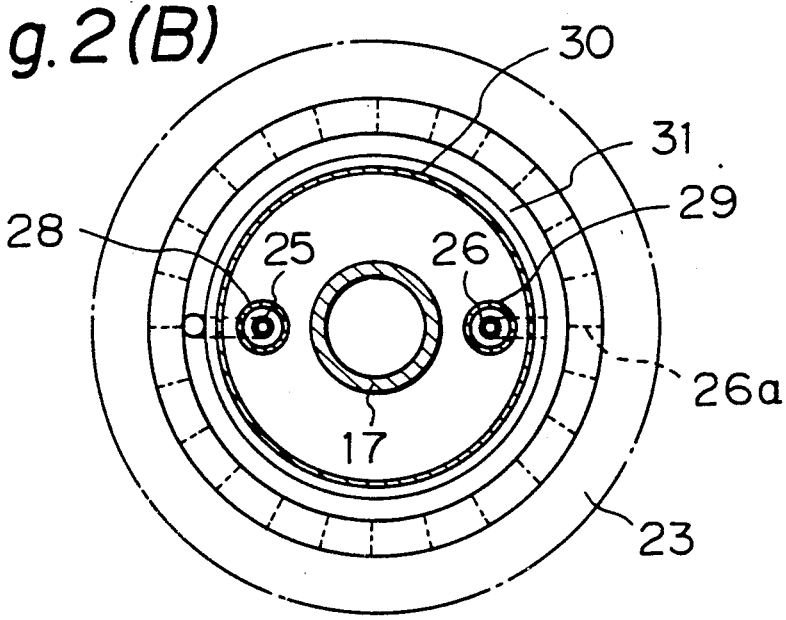

Referring to FIG. 2, the essential part of the core shown in FIG. 1 is illustrated in an enlarged view. FIG. 2(A) is a vertical cross sectional view of the core. FIG. 2(B) is a cross sectional view along the line A—A' of FIG. 2(A). At a contact part of the lower surface of the header 18 and the top surface of the core 16, O rings 28 and 29 are inserted. The O rings 28 and 29 are disposed at positions surrounding the gas-introduction pipe 25 and the lubricating oil-introducing pipe 26. O ring 30 is also inserted at the contact parts inside the grooves for distributing gas around the core. Accordingly, the O rings 28, 29 and 30 prevent at the contact part the leakage of the gas and lubricating oil. The groove 31 for distributing gas around the core has an annular configuration and is formed on the top surface of the core 16 and near the outer peripheral surface of the core 16. The gas is introduced from the gas-introduction groove 31 via the slits 24 to beneath the overhang 23, where the gas forms the annular gap 23*a* and applies the pressure to the inner peripheral surface of the molten metal 10. Minute clearances are formed between the thin, deformable solidified shell of the molten metal having not yet rigidity and the inner peripheral surface of the core 16. Excessive gas flows downwards out of the annular gap 23*a* through the minute clearances.

An annular groove 26*b* is formed in the outer peripheral part of the core 16, so as to distribute the lubricating oil around the core 16. The lubricating oil is fed through the introduction conduit 26, then fills the annular groove 26*b*, and exudes to the outer peripheral surfaced of the core 16 to wet such surface. Natural vegetable oil, such as castor oil, peanut oil, and rapeseed oil, or synthetized lubricating oil can be used alone or in combination as the lubricating oil. The lubricating oil used, however, is not limited to these oils.

Figure 3:
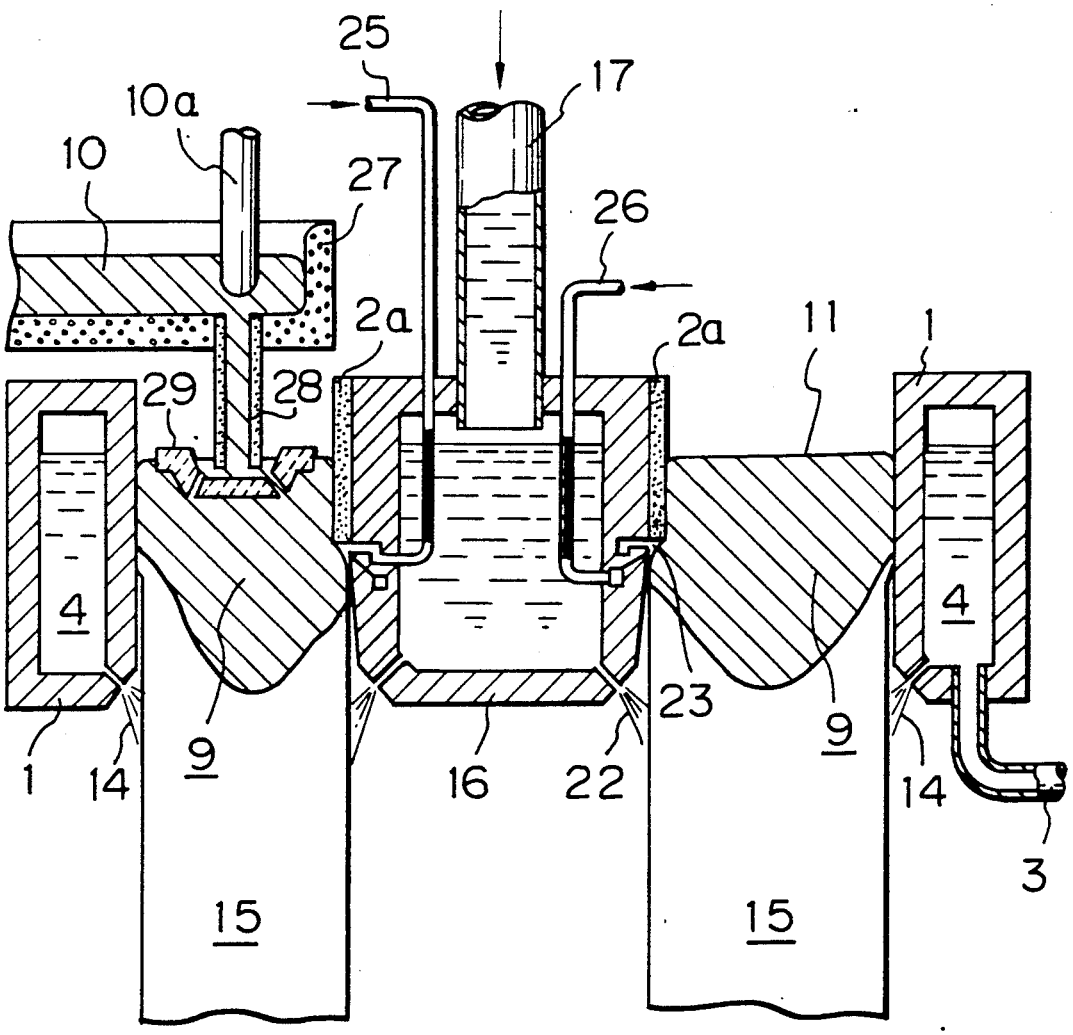
FIG. 3 shows an apparatus of Example 2, in which the first invention is applied to the float casting method.

Referring to the apparatus shown in FIG. 3, an application of the first invention to the float casting method is illustrated. The tubular mold 1 is forcedly cooled by the cooling water which flows in through the introduction conduit 3. A cylindrical core 16 is held concentrically inside the tubular mold 1. The core 16 is forcedly cooled by the cooling water which flows in through the introduction conduit of a pipe 17 into the core 16. The top surface of the tubular mold 1 is flush with that of the core 16. Metallic molten metal 10 is stored in a tundish 27 and is then poured into an annular clearance between the tubular mold 1 and the core 16 via the bottom end of a tapping plug 10*a*, a spout 28 and then a float 29. The float 29 controls the level of the molten metal surface 11 within the mold. An overhang 23 is formed in the proximity of and above the level, where the solidification starts, for mitigating the cooling of molten metal by the core 16. Refractory heat-insulative felt 2*a* surrounds the outer peripheral surface of a core 16, and the overhang 23 is defined by the lower end of the felt 2*a*. The outer peripheral surface of a core 16 is provided with an inversely conical shape which is commensurate with the progress of shrinkage of an ingot in the axial direction during solidification. A conduit 25 for introducing pressured gas protrudes through the core 16 from its top side to the interior. A conduit 26 is provided for introducing the liquid lubricating agent. These conduits 25 and 26 are communicated with the distributing grooves having the same structure' as in Example 1. From these slits via the respective slits, the pressured gas and lubricating agent flow off. As a result, the pressured gas is fed directly beneath (23*a*) the overhang and the lubricating agent is fed to the outer peripheral surface of the core. The pressured gas and lubricating agent are fed, as in Example 1, via mechanisms for controlling the pressure and flow rate of fluids (not-shown).

Figure 4:
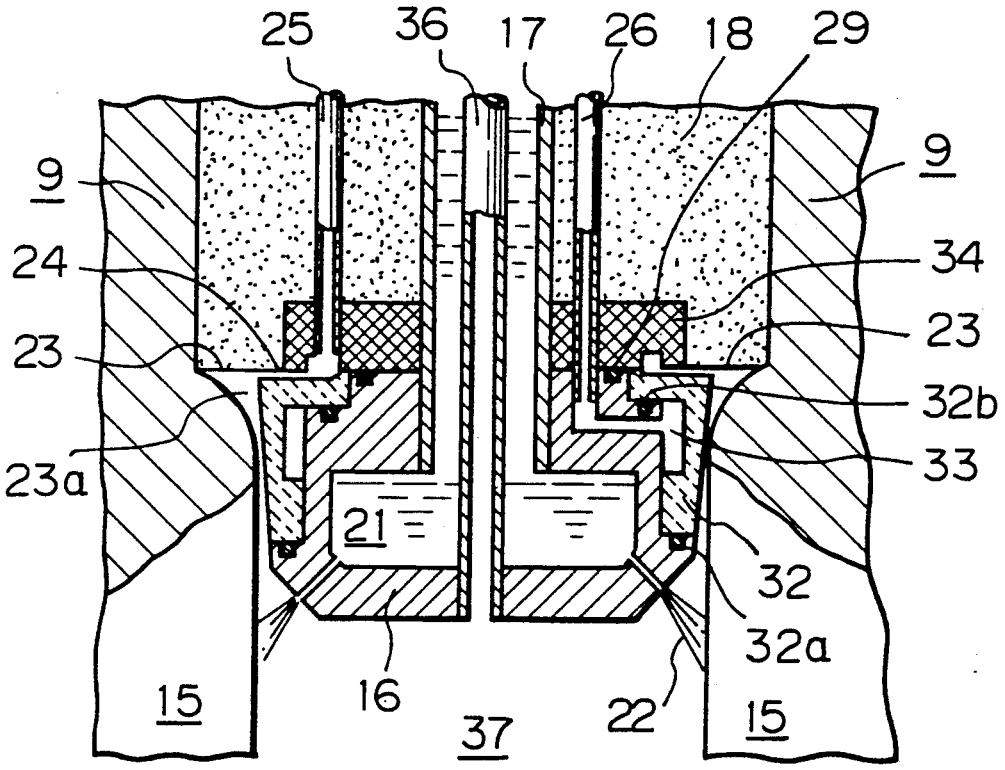
FIGS. 4 and 5 show the apparatuses of Examples 3 and 4, respectively, in which a gas-permeable refractory ring is fitted around the outer peripheral surface of a cooling core.

The apparatus shown in FIG. 4 is used as a core in the hot-top method described in Example 1. The core 16 is forcedly cooled. A header 18 which is made of refractory heat-insulative material is rigidly connected to the top surface of the core 16. The header 18 protrudes, at its bottom end, uniformly outwards beyond the outer peripheral surface of the core 16. The overhang 23 is therefore formed around the outer peripheral surface of the core 16. A heat conductive and gas-permeable ring 32 is inserted around the outer peripheral surface of the core 16. O rings 32*a* and 32*b* are disposed at the contact part of this ring 32 and the core 16 so as to make this contact part gas tight. An annular groove 33 is formed at the contact part of the heat conductive and gas-permeable ring 32 and is communicated with an introduction conduit 26 for the lubricating agent which protrudes through the heater 18. The lubricating agent is fed through the annular groove 33 and then exudes on the outer peripheral surface of the ring 32. Porous graphite (for example, commercially available under the trade name of ATJ produced by the Union Carbide Corporation) or sintered powder metal can be used as the heat conductive and gas-permeable material. The size of the pores of this material is so fine that the molten metal does not infiltrate therein.

A spacer 34 made of metal is inserted in the lower end of the header 18 so as to enhance gas tightness. A conduit 25 for introducing the pressured gas protrudes through the header 18 and the spacer 34 and is connected with a part of an annular groove 35 which is formed on the lower end of the spacer. Slits 24 radially extend from the annular groove 35 toward the overhang 23. Gas therefore passes through the slits 24. An 0 ring 29 prevents the leakage of introduced gas.

The groove 33 in the refractory and gas-permeable ring 32 is preferably positioned as close as possible to the overhang 23 and in such a vertical position that molten metal contacts part of this ring 32 which is approximately flush with the level of the groove 33. The groove is preferably in the form of a strip around the core body.

Desirably, the outer peripheral surface of the refractory and gas-permeable ring 32 is provided with a taper in the casting direction. A pipe 36 is positioned inside and concentrically with, the pipe 17 for introducing cooling water, protrudes through the core 16. The pipe 36 is opened to ambient air at the top end (not shown) thereof and is opened to the inner space 37 of a hollow ingot 15. The pressure of the inner space 37 of the hollow ingot can therefore be maintained atmospheric pressure due to the pipe 36. This pipe 36, which has the function of pressure maintenance mentioned above, is however not essential.

Figure 5:
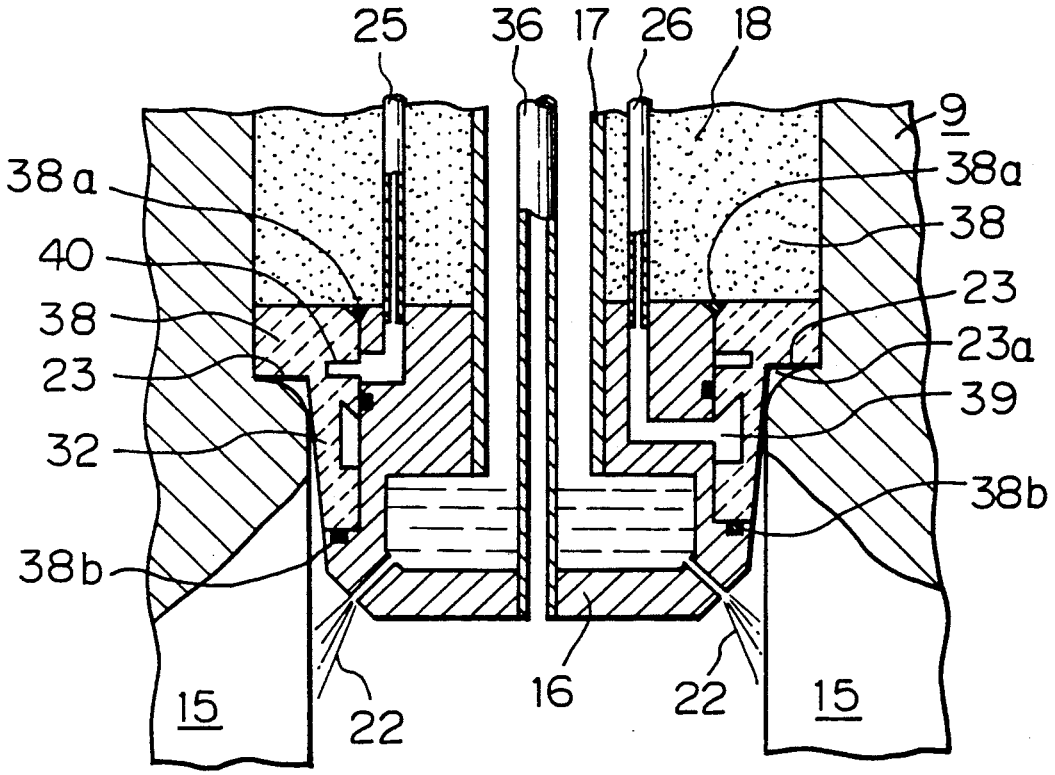

The apparatus shown in FIG. 5 is another embodiment different from that shown in FIG. 4 and is appropriate for a core used in the hot-top casting method.

A heat conductive and gas-permeable ring 32 made of refractory material is inserted around the outer peripheral surface of a core 16, as in FIG. 4. This ring 32 includes an upper part which is in the form of a flange uniformly protruding outwardly and thus forms an overhang 23. A refractory heat-insulative header 18 is rigidly provided on the core 16 and the flange. O rings 38*a* and 38*b* are inserted at a contact part between the header 18, the flange and the core 16 so as to prevent leakage of gas and lubricating oil from the contact parts. Lubricating oil is passed through the header 18 and is then introduced into the core body with the aid of a conduit 26. The lubricating oil is then distributed around the annular groove 39 which groove is formed in the core inside the gas-permeable ring 32. The position of annular groove 39 as seen in the vertical direction is above the contact position of the molten metal with the outer peripheral surface of the gas-permeable ring 32 and is beneath the overhang 23. The top part of the annular groove 39 extends upwards thereby directing lubricating oil directly beneath the overhang 23. Lubricating oil fills the annular groove 39, then permeates through the gas-permeable ring 32, and wets its outer peripheral surface.

Meanwhile, the gas is introduced through the header 18 and then the core body with the aid of a conduit 25. This conduit is connected with one part of a horizontal annular groove 40, which is provided inside the flange of the gas-permeable ring 38 near the overhang 23. The gas is therefore distributed around the horizontal annular groove 40 and is then fed directly beneath the overhang 23. The gap 23*a*, where gas pressure is applied, is therefore formed.

Figure 6A:
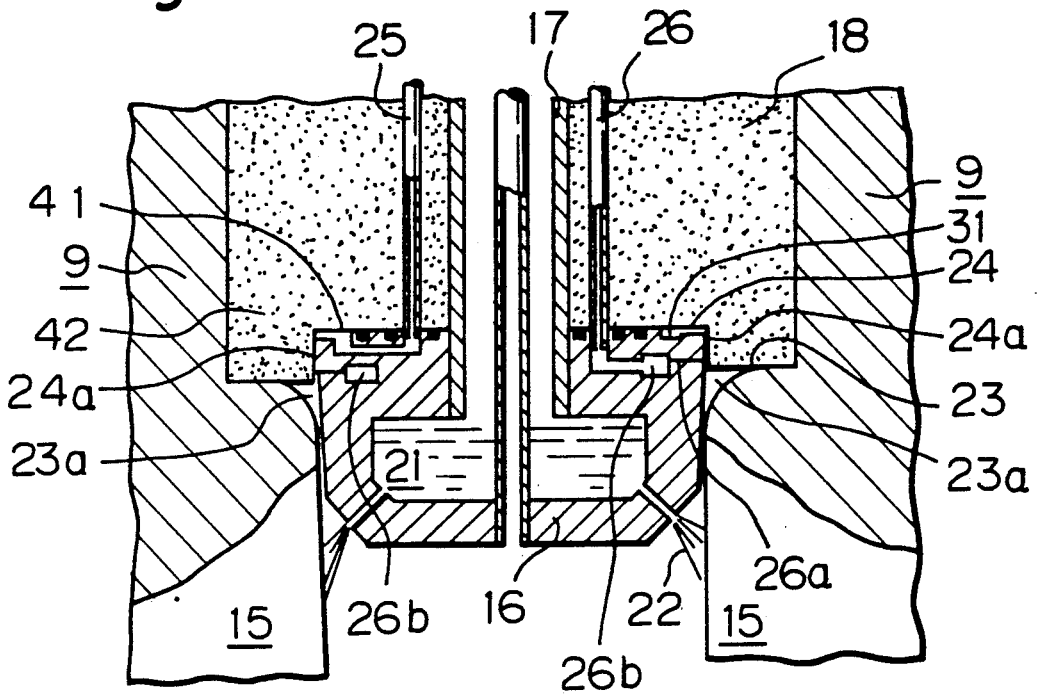
FIG. 6(A) is a vertical cross sectional view of the core used in Example 5.

The apparatus shown in the vertical cross sectional view of FIG. 6A is an example of core used in the hot-top method shown in FIG. 1. A header 18 is provided with a recess on the bottom end 41. The core 16, which is forcedly cooled, is inserted, at its top end, in the recess 41. The header 18 includes, in its lower periphery, a protruding art 42 protruding downwardly which covers the upper outer peripheral surface of the core 16. This downward part 42 protrudes uniformly outward beyond the outer peripheral surface of the core 16.

The conduit 26 for feeding lubricating oil protrudes downwards through the header 18 and is connected, at its lower end, with one part of the annular groove 26*b* in the core 16. Capillaries 26*a* branch off from the annular groove 18 and end on the outer peripheral surface of the core 16. The lubricating oil passes through the capillaries 26*a* and wet the outer peripheral surface of the core 16. The conduit 25 for introducing pressured gas protrudes downwards through the header 18 and is connected, at its lower end, with a part of the annular groove 31. A minute slit 24 is connected with the annular groove 31. Minute slits 24*a* are formed between the outer peripheral surface of the core 16 and the downwardly protruding part 42 of the header 18 and are connected in turn with the minute slit 24. The minute slits 24*a* are opened directly beneath the overhang 23. Pressured gas is therefore fed through 25, 31, 24 and 24*a* and forms an annular gap 23*a*, where the gas pressure is applied, so as to decrease the contact area of the molten metal with the core surface, which is forcedly cooled.

Figure 6B:
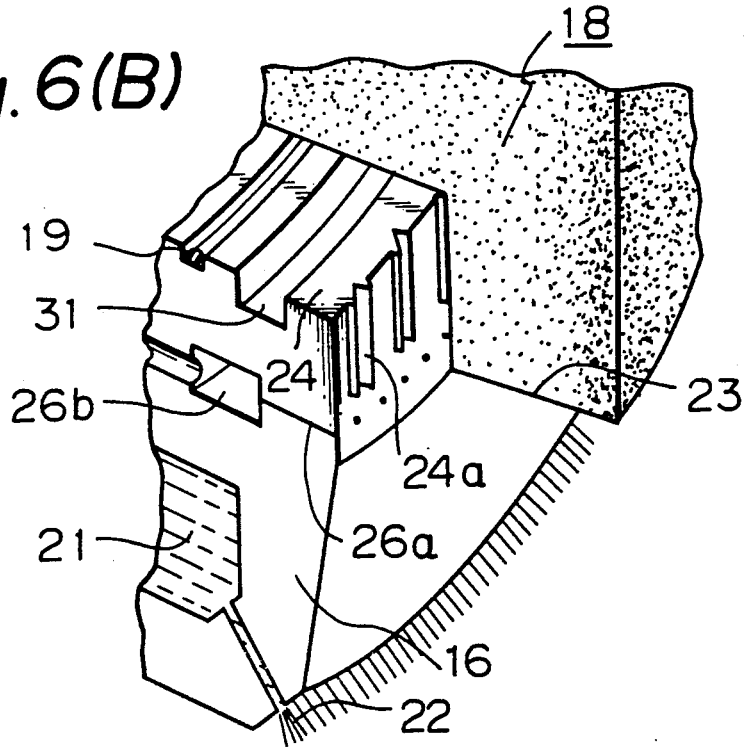
FIG. 6(B) is an elevational view of the cross section of a core of FIG. 6(A).

Referring to FIG. 6B, a partial cross sectional and elevational view of FIG. 6A is shown. Minute slits 24*a* are formed by knurling tool in the form of vertical minute grooves. These minute slits 24*a* are preferred for the passage of gas, since the minute slits 24 do not clog.

Figure 7:
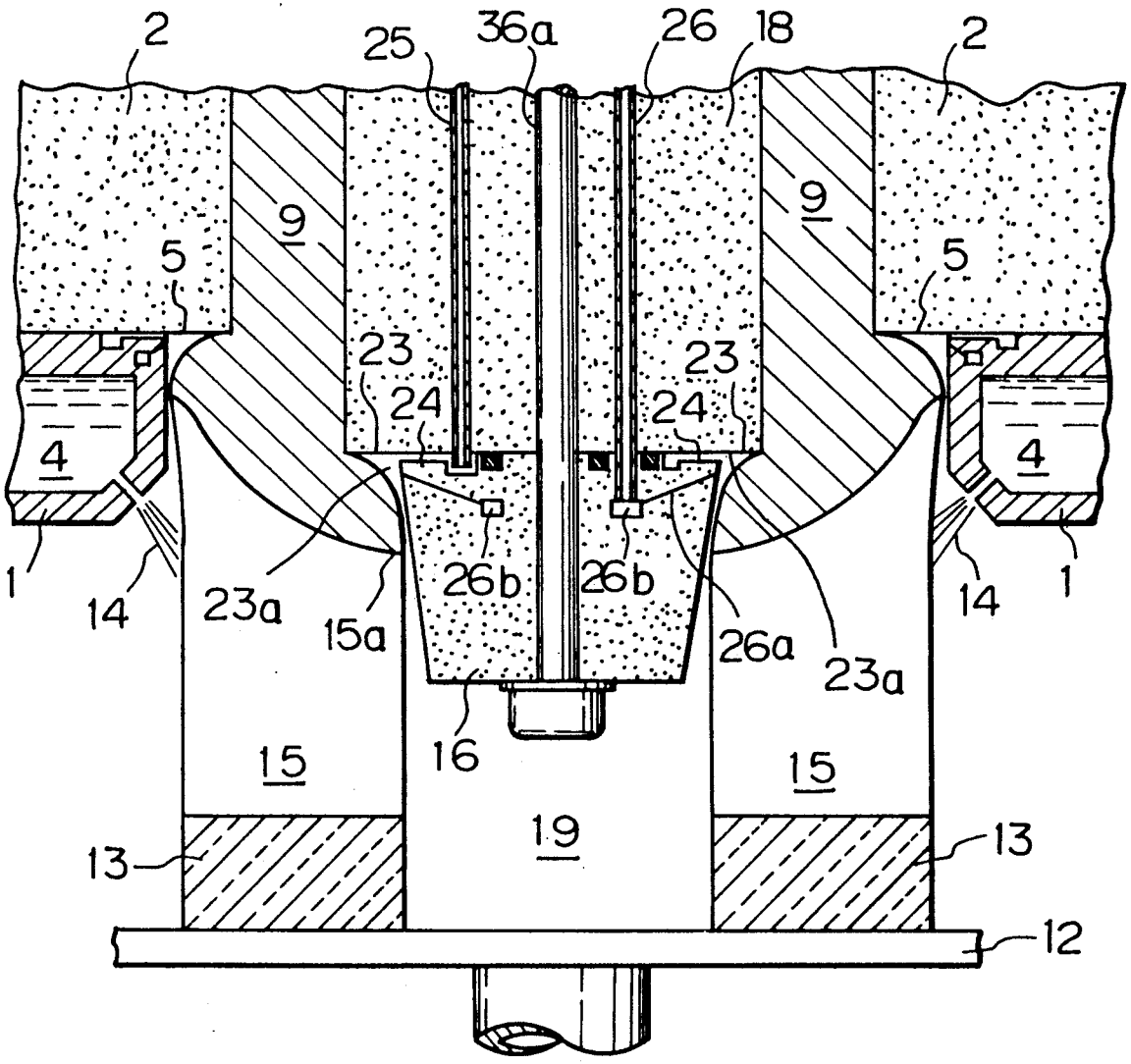
FIG. 7 illustrates an application of the present invention to the hot-top casting method and shows a vertical cross sectional view of a non-forcedly cooled core.

Referring to FIG. 7, a modification of the hot-top casting method illustrated in FIG. 1 is illustrated. In this embodiment the present invention is applied to a non-forcedly cooled core. A core 16 made of refractory heat-insulative material (trade name, LUMIBOARD) is integrally bonded by means of a bolt 36*a* with a header 18 which is made of the identical refractory heat-insulative material. The lower end of the header 18 protrudes externally beyond the outer peripheral surface of the core at its upper end and hence forms an overhang 23. Pressured gas and lubricating oil are fed through the conduits 25 and 26, respectively, which protrude through the header 18. Pressured gas, for example air, is fed toward 23*a*, directly beneath the overhang, and, lubricating oil is fed toward the outer peripheral surface of the core, as in the embodiment illustrated in FIG. 1. The overhang is positioned in the molten metal and directly above the solid-liquid interface 15*a*, such that the distance between the level of the overhang 23 and the solid-liquid interface 15*a* is preferably 30 mm or less, more preferably 10 mm or less.

Figure 26:
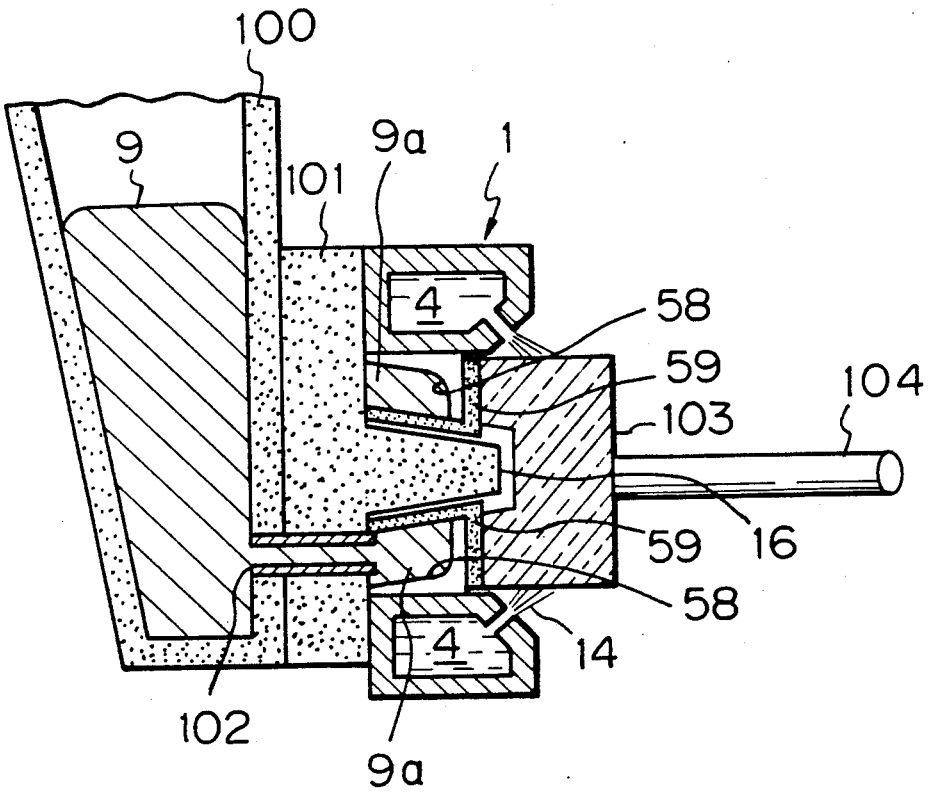
FIG. 26 illustrates an embodiment, in which the third invention is applied to the horizontal continuous casting method.
Figure 27:
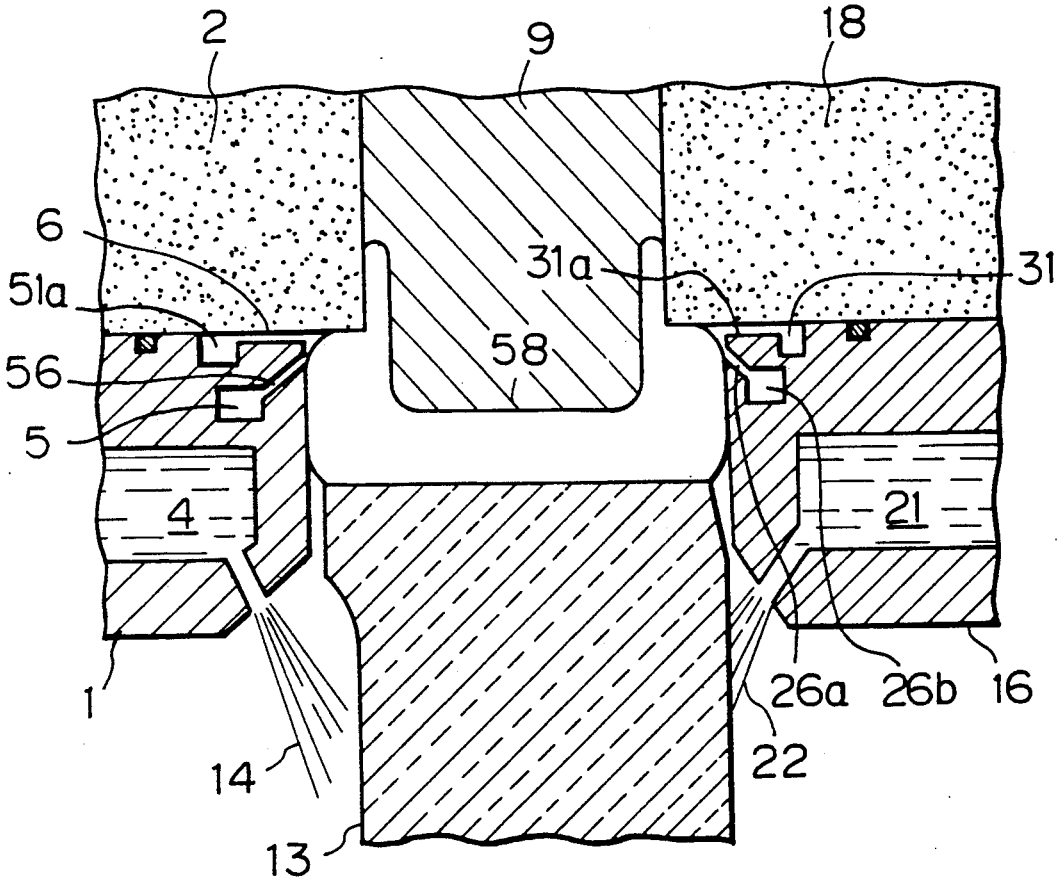
FIG. 27 illustrates casting-start according to the conventional method.

In FIGS. 12 through 30, except for FIG. 27, the embodiments of the third invention are illustrated. The same parts of a continuous casting apparatus shown in FIGS. 12 through 30 as in FIGS. 1 through 7 are denoted by the same reference numerals. These parts are not described with reference to FIGS. 12 through 30 for the sake of brevity.

Figure 12:
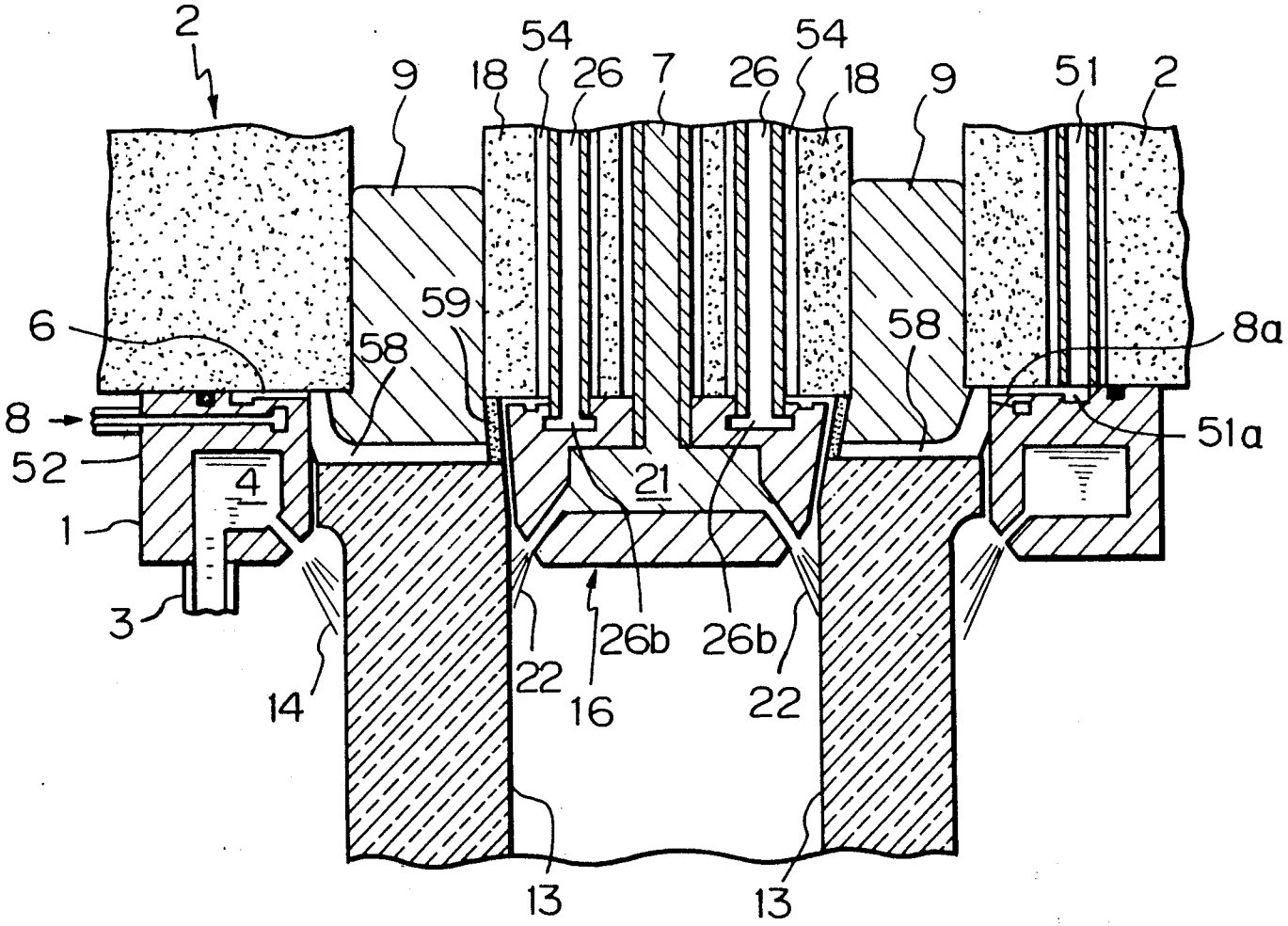
FIG. 12 is a partial cross sectional view of a vertical continuous casting apparatus, in which a core is covered with a refractory heat-insulative ring.
Figure 13:
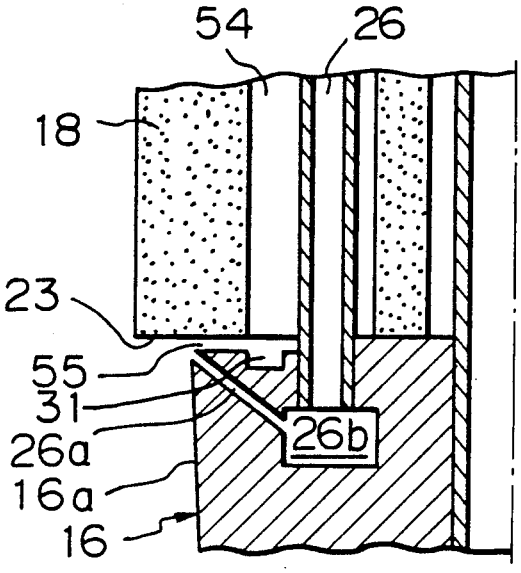
FIG. 13 is a partial enlarged view of FIG. 12.

In FIGS. 12 and 13, the reference numeral 51 denotes a conduit for feeding gas. The fed gas is thus introduced to the annular groove 51*a* which is formed on the top surface of the tubular mold 1 and circumferentially around the conduit 7. The core 16 is suspended in the cavity of tubular mold 1 by a suspension mechanism (not shown). The secondary cooling water 22, which flows out from the core 16, cools the movable bottom block 13 during the initial casting period and then cools, after the initiation of casting withdrawal, the inner surface of the hollow ingot. Due to this cooling function, the solidification interface is maintained in an appropriate position as seen in the casting direction during the continuous casting of the hollow ingot.

The annular gas-passage 54 is formed between the header 18 and the conduits 26 for feeding the lubricating oil. Before casting, a refractory heat-insulative ring 59 is fitted around the outer peripheral surface of the core 16. When molten metal is poured into a continuous casting apparatus, it is subjected to the primary cooling action by means of the movable bottom block 13 and the tubular mold 1. The solidified shell 58 is consequently formed. Since the refractory heat-insulative ring 59 is present beside the core 16, the solidified shell 58 grows relatively slowly on this ring 59 as compared with the growth on the movable bottom block 13 and the tubular mold 1. Referring to FIG. 27, the growth of the solidified shell in a case without refractory heat-insulative ring 59 is illustrated. The solidified shell 58 on the outer peripheral surface of a core !6 and the other surfaces grows in a uniform thickness. In accordance with solidification-shrinkage of the solidified shell 58, the core 16 is encased by the cast metal solidified thereon. Although the draft 16*a* is formed on the outer peripheral surface of the core 16, the draft 16*a* does not function to realize smooth withdrawal of the ingot in cases where the encasement force of the cast metal is high.

Figure 14:
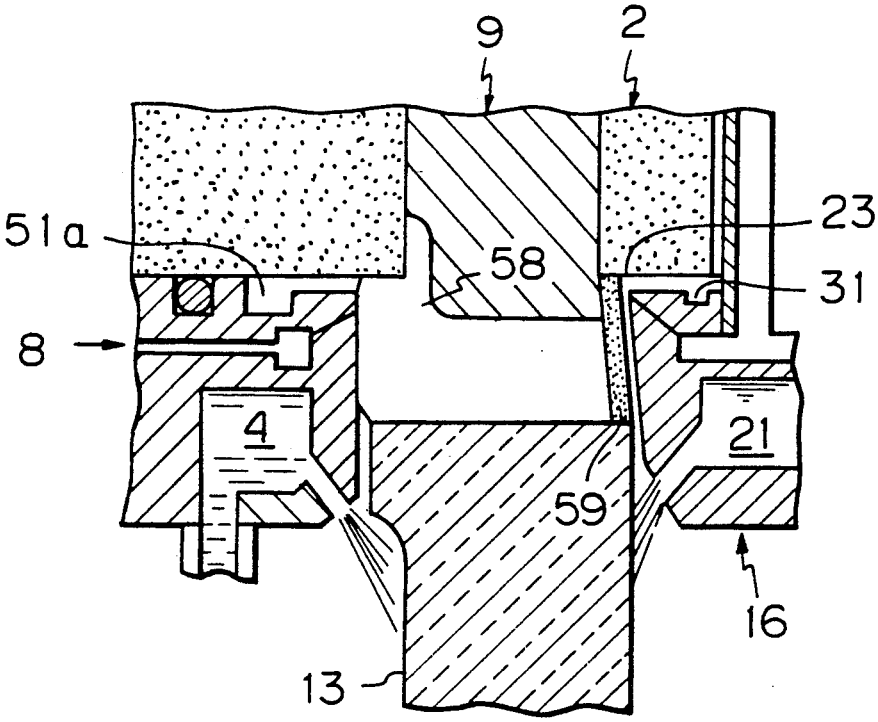
FIG. 14 illustrates that solidification is advanced as compared with the state shown in FIG. 12 to enable withdrawal of the movable bottom block.

Referring to FIG. 14, the solidification is more advanced than that shown in FIG. 12. The solidified shell 58 grows further and finally grows on the refractory heat-insulative ring 59. The refractory heat-insulative ring 59 is therefore encased by the cast metal of the solidified shell 58 as shown in FIG. 14. This ring 59 is detachably fitted around the core 16 so that the ring 59 can be withdrawn at the start of casting. If the refractory heat-insulative ring 59 is rigidly secured with the core 16, when the movable bottom block 15 and hence the ring 59, which is encased in the cast metal of the solidified shell 59, are withdrawn at casting start, the ring 59 is partly broken and its fragments are engulfed in the solidified shell 58 to form cast defects. In this case, an object of the third invention is not attained. The refractory heat-insulative ring 59 may be loosely fitted around the core 16, be roughened on the surface thereof, or be made integrally in the form of a net, so as to firmly bond the solidified shell 58 with the ring 59.

Referring to FIGS. 15 through 18, preferred embodiments for ensuring withdrawal of a refractory heat-insulative ring 59 together with a movable bottom block 13 and for ensuring bonding between the solidified shell 58 and the ring 59 are illustrated.

Figure 15:
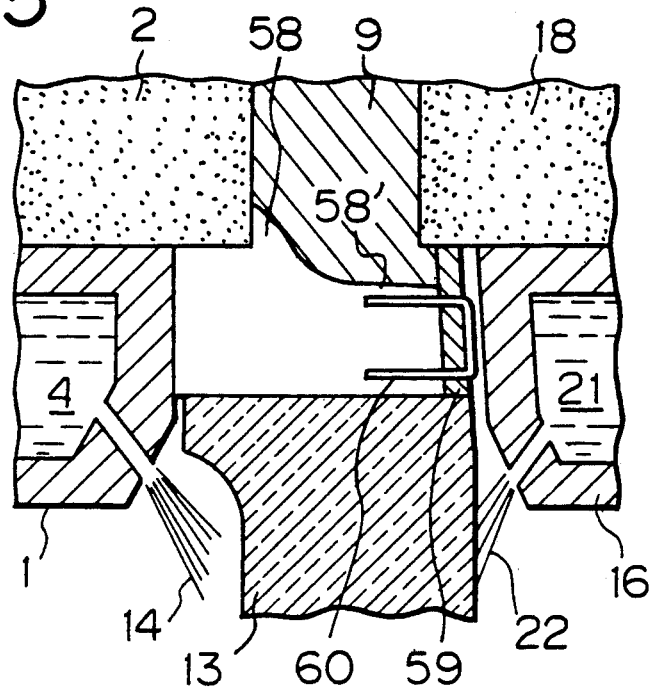
FIGS. 15 and 16 illustrate the casting start with the aid of a refractory heat-insulative ring provided with the lugs shown in FIG. 17.
Figure 16:
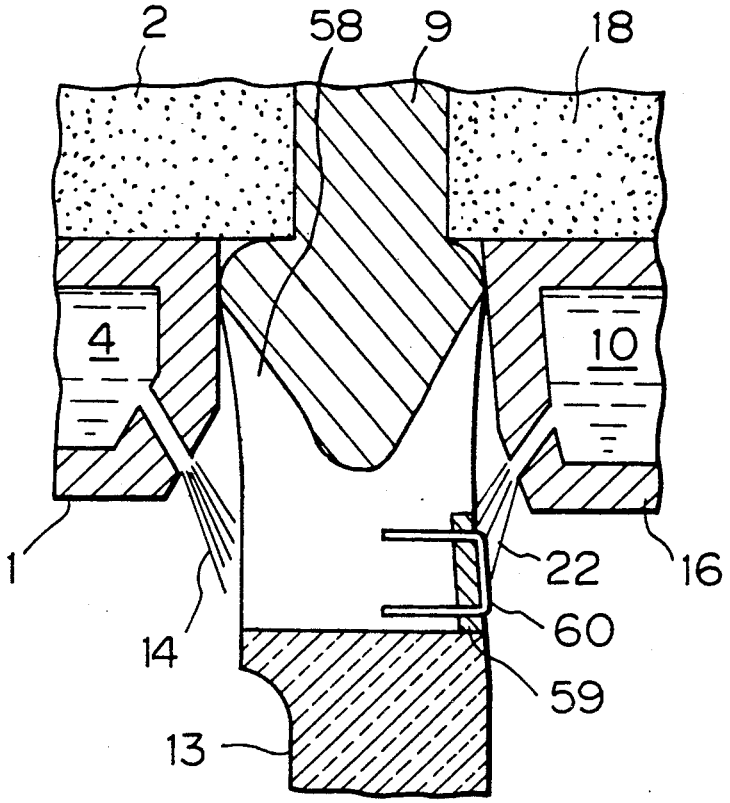
Figure 17:
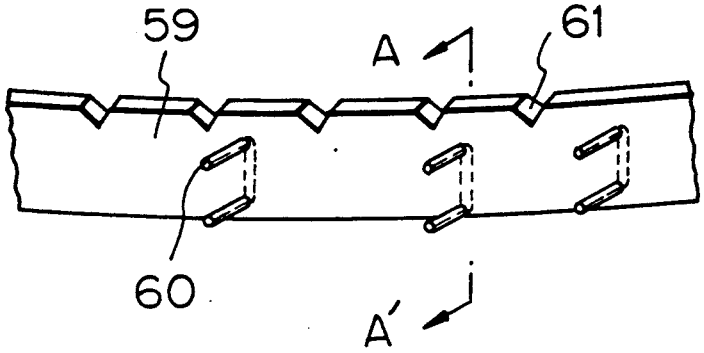
FIG. 17(A) illustrates an example of lugs provided on the refractory heat-insulative ring.
FIG 17(B) is a cross sectional view along the line A—A' of FIG. 17(A).
Figure 17:
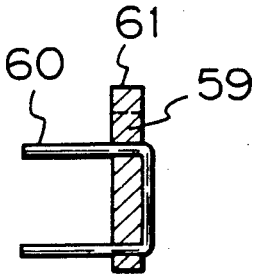

In FIG. 15, the details of the tubular mold 1 and the core 16 are omitted. Reference numeral 60 denotes lugs made of material difficult to erode with molten metal 9 (for example, in the case of aluminum molten metal, steel). The lugs 60 protrude through the refractory heat-insulative ring 59 and extend into the mold cavity. The lugs 60 are therefore encased by the cast metal which solidifies on them. The lugs 60 shown in FIG. 15 is in the form of "ᒧ" having a part facing the core 16 and reinforcing the protrusions. This part is not essential, since it merely reinforces the protrusions. The solidified shell 58 grows as shown in FIG. 15, and solidifies on and encases the lugs 60. The solidified shell 58 and refractory heat-insulative ring 59 are therefore bonded with each other securely. When a hollow ingot, in which the bonding mentioned above has been attained, is withdrawn, the entity (58, 59 and 60) lowers while growth of the solidified shell 58 is promoted further as shown in FIG. 16.

Referring to FIGS. 17(A) and (B), a partial magnified view of a refractory heat-insulative ring 59 is shown. The lugs 60 are made of staples. Reference numeral 61 denotes cooling grooves in U or V shape, formed by notching the upper edge of the refractory heat-insulative ring 59. Molten metal enters the grooves 61 and solidification starts there. The grooves 61 therefore behave as the solidification starting points in the molten metal 7. The encasement is therefore improved by both grooves 61 and lugs 60, thereby completely encasing the refractory heat-insulative ring 59 with the metal solidified on it 59 and hence ensuring the withdrawal of ring 59 together with the movable bottom block.

Figure 18:
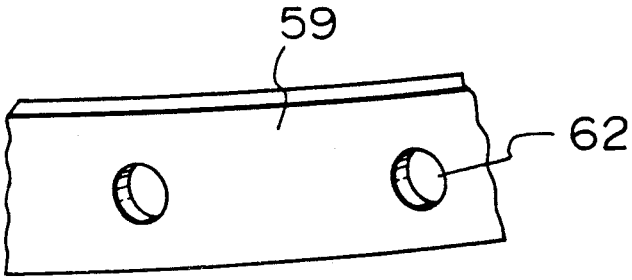
FIG. 18 illustrates an example of cooling holes of a refractory heat-insulative ring.

Referring to FIG. 18, cooling holes 62 having the same function as the cooling grooves are illustrated. When molten metal enters the cooling holes 62 during the initial casting period, the solidification occurs earlier in the cooling holes 62 than on the major surfaces of the refractory heat-insulative ring 59. The cooling holes 62 therefore behave as the solidification starting points in the molten metal 7. Preferred diameter of the cooling holes 62 in the range of from 1.5 to 15 mm. Below this range, the effects of the cooling holes are poor. Above this range, it is difficult to mitigate, by the major surface of a refractory heat-insulative ring 59, chilling action of the core. The shapes of the cooling holes are not limited to being round. They may be rectangular, triangle, polygonal or slots.

Figure 19:
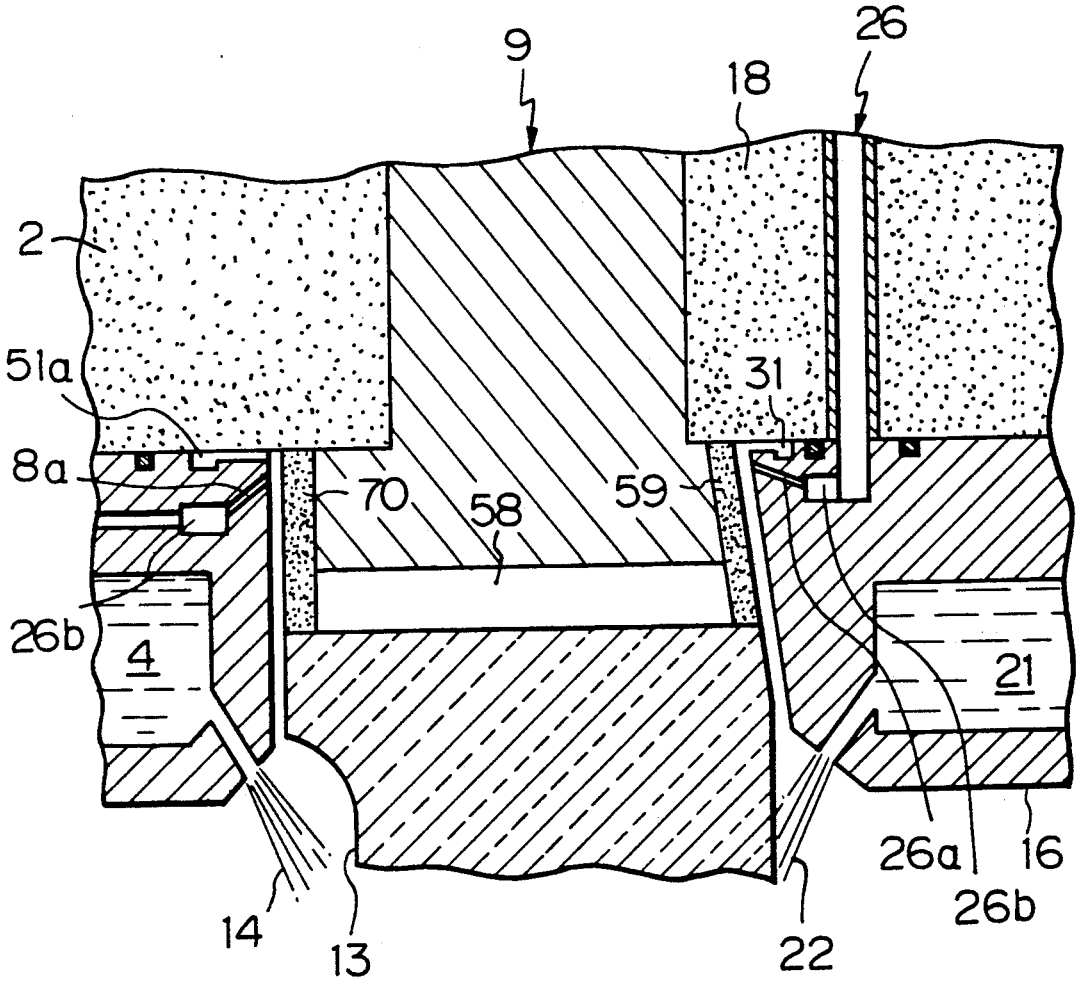
FIG. 19 is a drawing similar to FIG. 12 and illustrates an embodiment, in which both core and mold are covered with a refractory heat-insulative ring.
Figure 20:
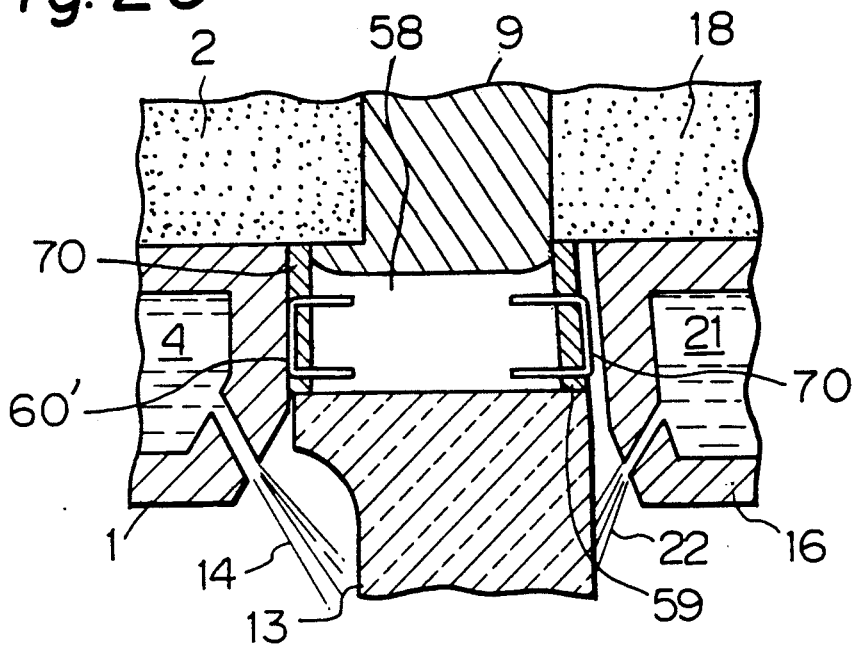
FIGS. 20 and 21 are cross sectional views illustrating the embodiment, in which withdrawal of a hollow ingot is started with the aid of refractory heat-insulative ring with lugs.
Figure 21:
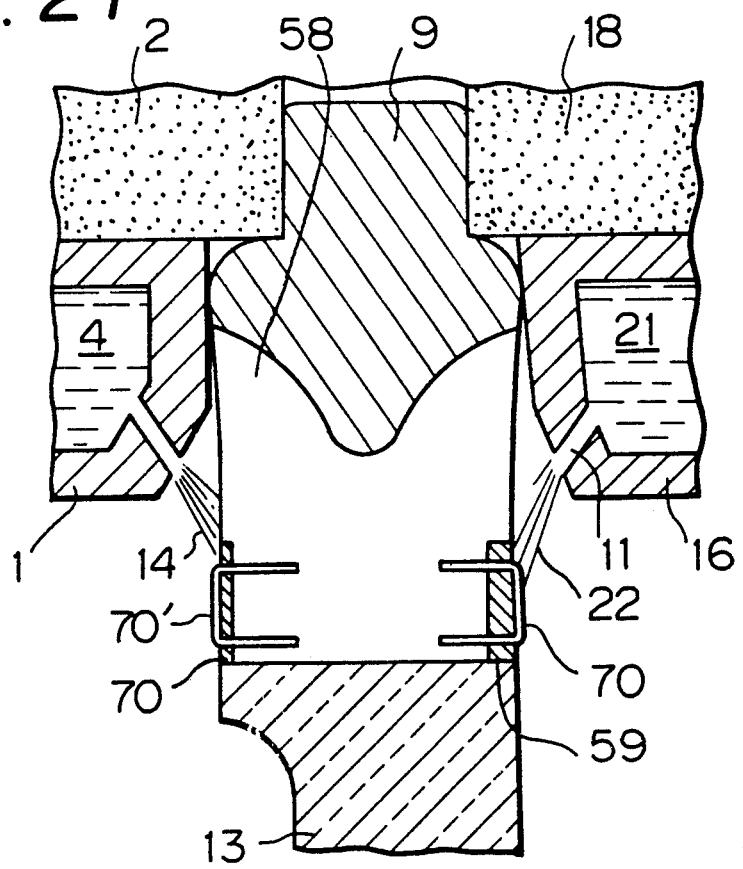

Referring to FIGS. 19, 20, and 21 several embodiments are illustrated, in which refractory heat-insulative rings are located in positions different from that shown in FIG. 12. In FIG. 19 the casting period is the same as in FIG. 12. In FIG. 19, the refractory heat-insulative rings 59 and 70 are located facing the outer peripheral surface of a core 16, and the inner peripheral surface of a tubular mold 1, respectively. The solidification on the peripheral surfaces of the mold 1 and the core 16 is therefore suppressed, while the solidification on the movable bottom block 13 is promoted due to heat withdrawal through this plate 13. Oriented solidification is consequently realized, so that the growth interface of the solidified layer 58 becomes flat. This in turn leads to a considerable delay in solidification in the hollow casting passage surrounded by the core 16, mold 1 and movable bottom block 13. In this case, withdrawal timing of a hollow ingot, which is determined by the instance of appropriate growth of the solidified shell, allows a large deviation from the criterion timing, because solidified shell grows slowly. The refractory heat-insulative ring 70 besides the tubular mold 1 must be withdrawn together with the hollow ingot as described with reference to FIG. 12. FIGS. 20 and 21 correspond to FIGS. 15 and 16, respectively. In these drawings, the solidified shell 58 is rigidly bonded with the refractory heat-insulative rings 59 and 60 at both mold- and core-sides with the aid of the lugs 60 and 60'.

Figure 22:
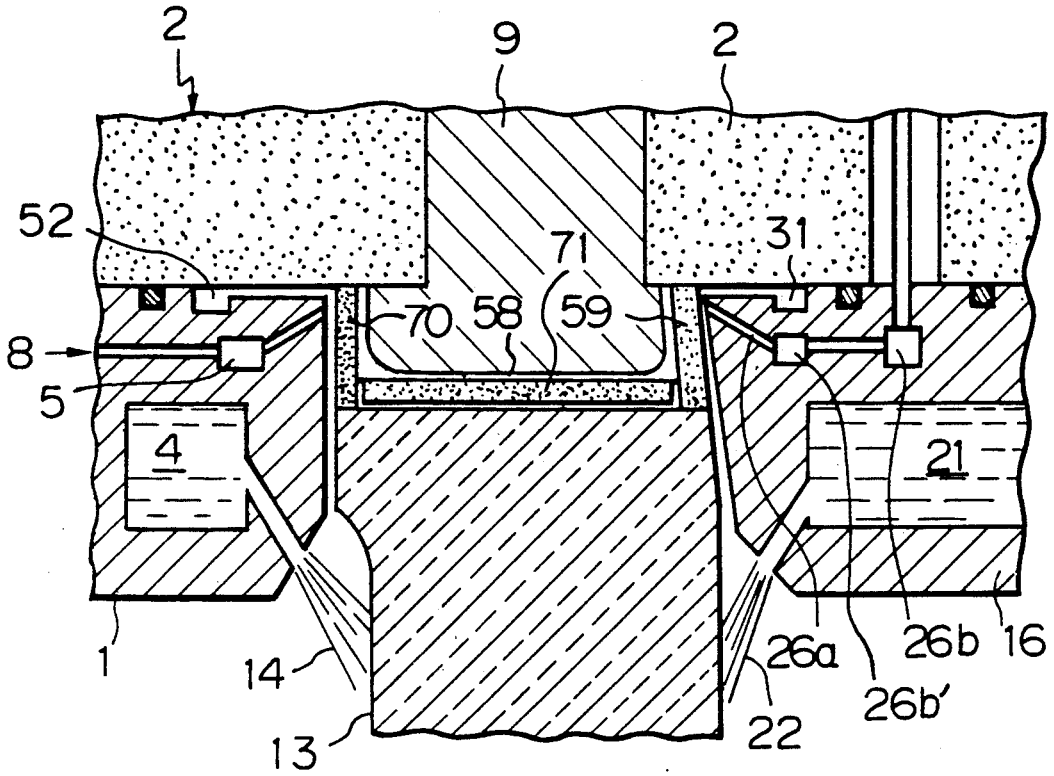
FIG. 22 is a drawing similar to FIG. 12 and illustrates an embodiment, in which all of the core, mold and movable bottom block are covered with a refractory heat-insulative ring.

Referring to FIG. 22, another embodiment is illustrated. In FIG. 22, the refractory heat-insulative rings 59 and 70 are located facing the outer peripheral surface of a core 16, and the inner peripheral surface of a tubular mold 1, respectively. A refractory heat-insulative sheet 71 is placed on the movable bottom block 13. As a result, solidification in the hollow casting passage surrounded by the core 16, mold 1 and movable bottom block 13 is considerably delayed. In this case, withdrawal timing of the hollow ingot allows a larger deviation from the criterion value than in the case of FIG. 19. The refractory heat-insulative rings 59, 70, and the refractory heat-insulative sheet 71 must be withdrawn together with a hollow ingot as is described with reference to FIG. 14.

Figure 23:
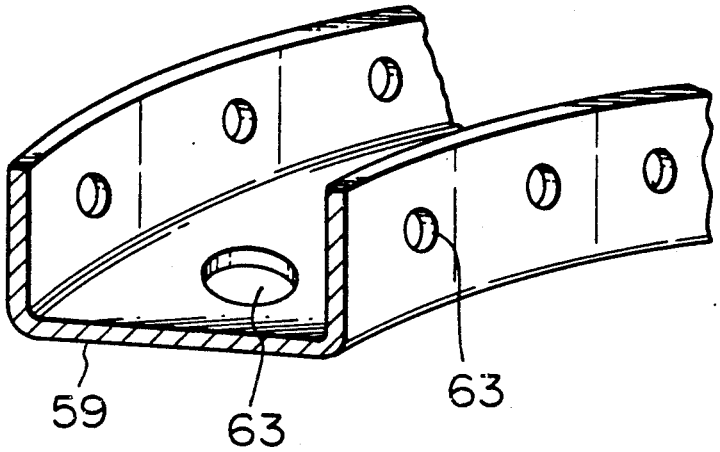

Referring to FIG. 23, the refractory heat-insulative rings 59, 70 and sheet 71 are integrally formed in the form of " ". A number of cooling holes 62 and 63 for providing the solidification initiation points are formed on the wall of refractory heat-insulative material 59, 70 and 71. Number and area of the cooling holes 62 and 63 are determined such that the retardation effect by the above material is actively maintained.

Figure 24:
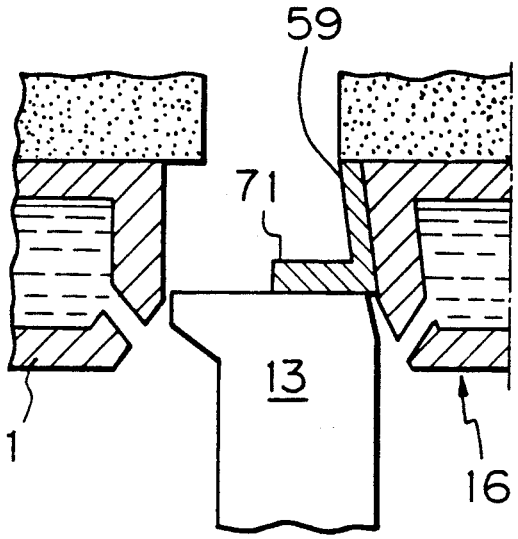
FIGS. 24 and 25 illustrates modification of the embodiments shown in FIG. 21.
Figure 25:
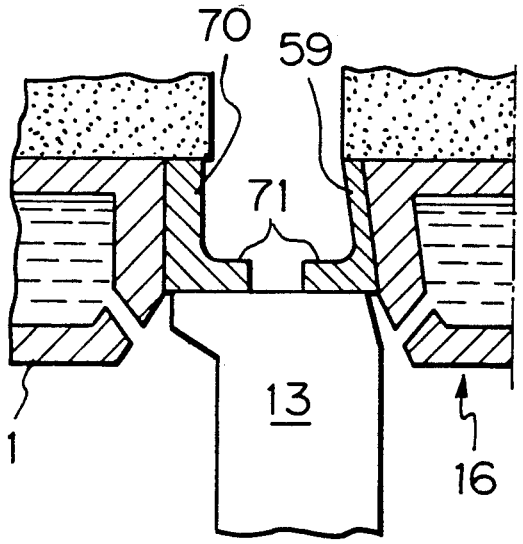

Referring to FIGS. 24 and 25, other embodiments are illustrated. In FIGS. 24 and 25, only a part of the top surface of the movable bottom block is covered with the refractory heat-insulative material. In the case of FIG. 25, the solidified shell begins to grow on the uncovered surface of the movable bottom block and then grows vertically and horizontally. The solidified shell then reaches the peripheral end of the refractory heat-insulative ring 71. During the subsequent period of shell solidification, it grows as if it creeps on the refractory heat-insulative ring 71. In a somewhat later period, a thin solidified shell is formed even on the refractory heat-insulative ring 59 which covers the core 16 and the tubular mold 1. Upon attaining such state of solidification, the solidified shell is rigidly bonded with the movable bottom block 13 and the refractory heat-insulative ring 59. The solidified shell and the ring 59 can therefore be withdrawn together when the movable bottom block 13 is withdrawn.

Figure 28:
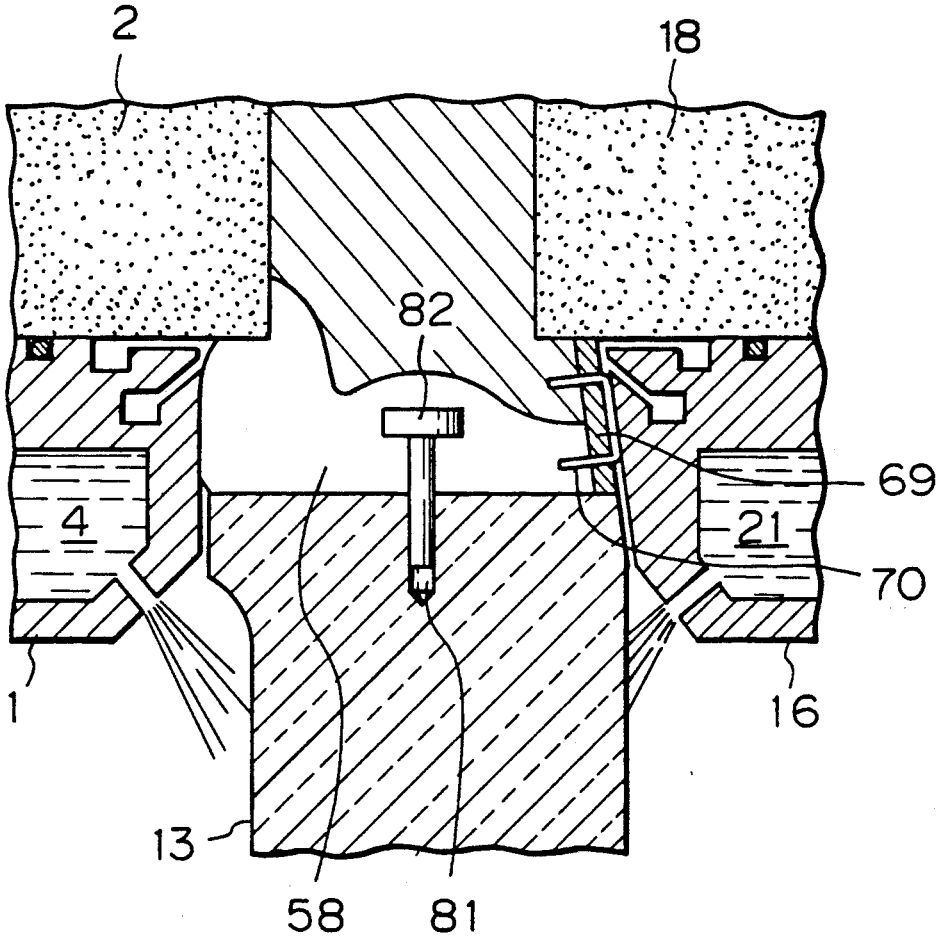
FIG. 28 is a partial cross sectional view of continuous casting apparatus according to an example of the present invention, illustrating a nail rigidly secured on a movable bottom block.
Figure 29:
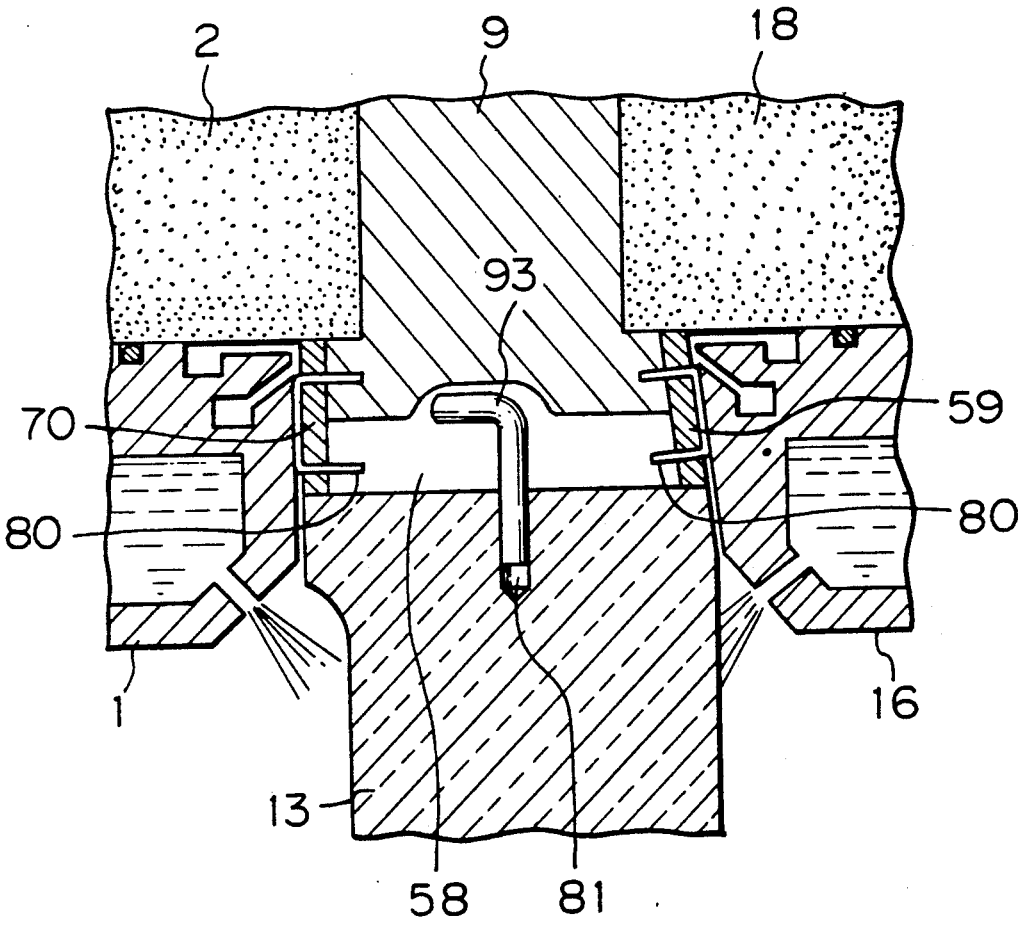
FIG. 29 is a partial cross sectional view of continuous casting apparatus according to an example of the present invention, illustrating a lug made of an inverse L shaped wire rigidly located on the movable bottom block.
Figure 30:
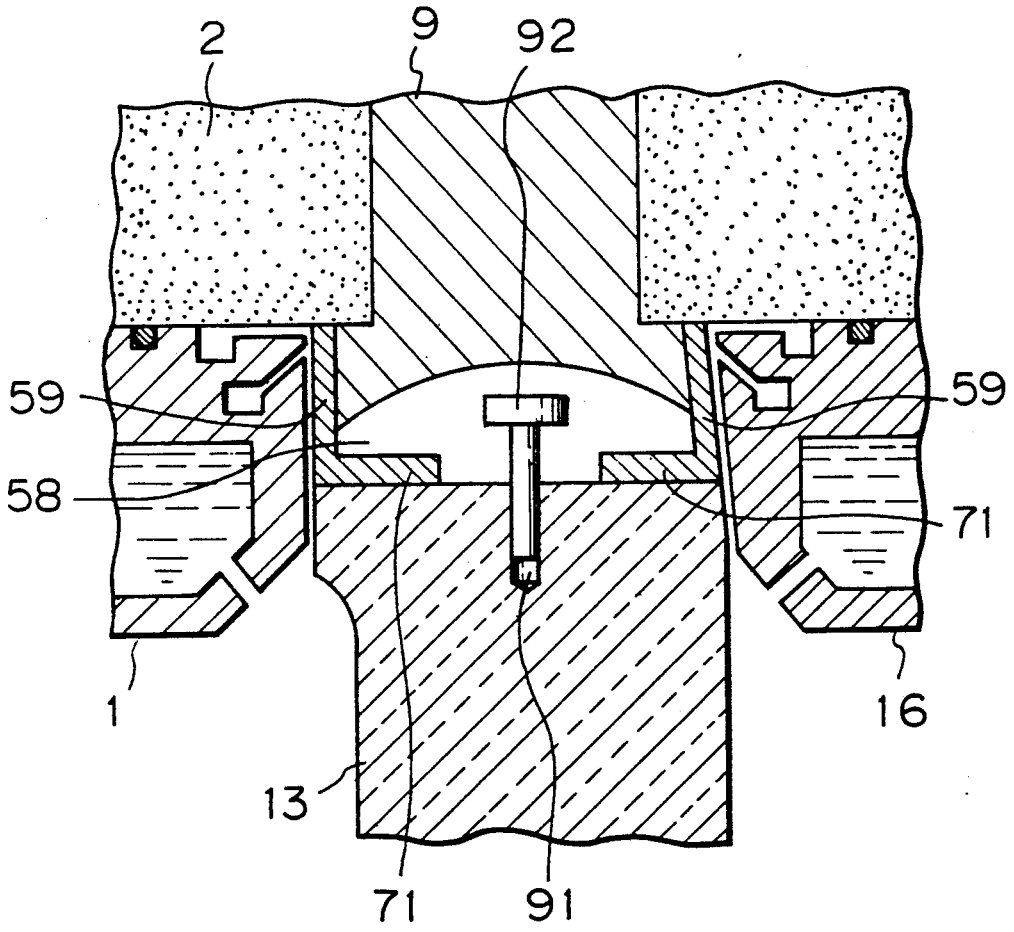
FIG. 30 is a partial cross sectional view of a continuous casting apparatus shown in FIG. 25 and having a steel nail rigidly located on the movable bottom block.

Referring to FIGS. 28, 29 and 30, other embodiments are illustrated.

In FIG. 28, the same casting period as in FIG. 15 and essential parts of a continuous casting apparatus are shown. A hole 81 is formed on the movable bottom block 13. A nail 82 made of copper is driven in the movable bottom block 13. In FIG. 29, the same casting period as in FIG. 20 and essential parts of a continuous casting apparatus are shown. A steel rod 93, the top of which is bent in an inverse L shape, is driven into a hole 81. In the cases of FIGS. 28 and 29, the nail 92 and steel rod 93 are encased with the solidified shell 58 growing on them 92 and 93. The solidified shell 58 is therefore furthermore rigidly bonded with the movable bottom block 13. As a result, the casting start is extremely stabilized.

In FIG. 30, the same casting period as in FIG. 25 and essential parts of a continuous casting apparatus are shown. A refractory heat-insulative ring 71 covers the mold and core as well as a part of the movable bottom block 13. A hole 91 is formed on the non-covered part of the movable bottom block 13. A steel nail 92 is forced into the hole 91. The solidified shell starts to grow on the non-covered surface of the movable bottom block. The solidification then occurs along the steel nail 92, and, a thin solidified layer is formed on the refractory heat-insulative ring 71. After the lapse of time, the steel nail 92 is encased with the solidified layer formed thereon, and this solidified layer is connected with a solidified layer which has grown on the uncovered part mentioned above. The steel nail 92 therefore contributes to rigid bonding between the solidified layer 58 and the refractory heat-insulative rings 59 and 71. They (92, 58 and 59) are withdrawn altogether at the withdrawal of an ingot. The casting start is very stable in the present embodiment.

Although the embodiments of the present third invention are described hereinabove with reference to vertical continuous casting apparatuses, the present third invention is equally applied to a horizontal continuous casting apparatus such as illustrated in FIG. 26. In FIG. 26, the parts of a continuous casting apparatus are denoted by the same reference numerals as in FIG. 12. A core 16 is made of non-cooled graphite. Reference numeral 100 denotes a molten metal reservoir. Reference numeral 101 denotes an intermediate orifice plate which is located between the molten metal reservoir 100 and the tubular mold 1 and secure them 100 and 1. Reference numeral 102 denotes a conduit for pouring the molten metal. Reference numeral 103 denotes a movable bottom block. Reference numeral 104 denotes a withdrawing rod of the movable bottom block 103. The temperature of molten metal is high in the tubular mold cavity at an inflow part through the conduit 102 for pouring molten metal, and is low at the side opposite to the inflow part. Temperature drop is for example by 20° C. in the case of aluminum alloy. The solidification becomes unbalanced due to such a temperature drop, particularly in the case of a casting a hollow ingot having a thin wall. It becomes consequently very difficult to set the withdrawal timing of the movable bottom block 103. It is very advantageous to overcoming this difficulty by disposing refractory heat-insulative material 59 on the outer peripheral surface of the core 16 and on the movable bottom block 103, where solidification is drastic.

The present invention is applied not only in the case of holding a core concentrically with respect to a tubular mold but also in the case of holding a core non-concentrically with respect to the core. In the latter case, a hollow ingot having an offset axis is obtained. In this case, the embodiment illustrated in FIG. 22 is preferably applied to a narrow annular clearance between the tubular mold and the core, and the embodiment illustrated in FIG. 12 is preferably applied to a wide clearance between the tubular mold and the core. The combination contributes to the elimination in unbalance of cooling and hence to stabilization of a continuous casting.

As described hereinabove, a refractory heat-insulative ring, which covers at least the core prevents the core from encasement by the cast metal and behaves as the bonding part with the molten metal during the initial solidification period. A refractory heat-insulative ring is withdrawn together with a hollow ingot. The refractory heat-insulative ring fulfills at the high degree the requirements of smoothening a cast skin and the formation of rigid bonding for withdrawal. These requirements are incompatible to one another, unless the present invention is used. In the present third invention, a rather great variation in the timing is allowed for starting the withdrawal of the movable bottom block. Surface qualities of the hollow ingot are improved and casting yield is hence enhanced. In addition, productivity is enhanced.

When molten metal leaks through the inner or peripheral surfaces of a hollow ingot accidentally, the molten metal leaked solidifies on the movable bottom block and the like. It is difficult to remove such solidified material from the movable bottom block and the like. Referring to FIG. 31, another embodiment of a vertical continuous casting apparatus according to the present invention is illustrated. When the solidified materials are leaked through the inner and outer peripheral surfaces of a hollow ingot and solidified on a movable bottom block and the like, these materials can be easily removed. The parts of this apparatus having the same reference numerals as in FIG. 12 are the same parts. Reference numeral 114 denotes a movable annular bottom block which is lifted, at the beginning of casting, upwards and is fitted in the bottom end of the annular clearance between the tubular mold 1 and the core 16. Reference numeral 112 denotes a table which is connected with a lifting mechanism (not shown) and which supports the movable annular bottom block 114. A carrier 120 is provided for carrying the movable annular bottom block and for facilitating the removal of solidified material. The movable annular bottom block 114 is placed on the legs 125 which are secured on the table 122. Between the legs 125 a block defined by one arris 119 and two slopes 117*a* and 117*b* is inserted. The lower ends of the movable annular bottom block 114, which are not supported by the legs 125, face the openings 118*a* and 118*b* above the slopes 117*a* and 117*b*.

Referring to FIG. 32, an embodiment of the present invention, which is applied to a float-type continuous casting apparatus, is illustrated. FIG. 32 shows the casting start. The same reference numerals in FIG. 32 as in FIG. 31 denote the same part of the apparatus as in FIG. 31. In the present embodiment, one slope 117 is formed at a position inside the movable annular bottom block 114 and a opening 118 is formed above this slope 117.

The angle of the slope is selected so that molten metal, which streams onto the slope 117, smoothly slip down the slope 117 and is withdrawn onto the table 122. This angle is adjusted depending upon the kinds of alloys, physical properties of the molten metal, and the like. This angle is 30° or more, generally speaking. Elevation of 45° is preferred. The opening 118 is preferably as great as possible, as long as strength of the legs 125 is not impaired. When the opening is narrower than the slopes, molten metal and water are disadvantageously liable to stagnate in the opening. The lower ends of the slopes 117 are preferably smooth, since any unevenness and steps at such connection impedes smooth falling down of the solidified materials. The apparatuses illustrated in FIGS. 31 and 32 are appropriate not only for casting of a round hollow ingot but also for casting of a hollow ingot having an irregular cross section.

Molten metal leaked along the outer peripheral surface of a core as well as secondary cooling water 22 of a core does not stagnate on the movable bottom block but is readily drained out from the movable bottom block onto a table 122. The table 122 becomes therefore wet. However an explosion due to contact of molten metal with water does not occur on the table 122, since there is no stagnation of water on the table 122. The solidified material fallen on the table 122 is easily peeled off it 122.

The first and second inventions are described by way of examples.

EXAMPLE 1

The hot-top casting method illustrated in FIGS. 1 and 2 was carried out.

EXAMPLE 2

The float-type casting method illustrated in FIG. 3 was carried out.

EXAMPLE 3

The hot-top casting method illustrated in FIG. 4 was carried out.

EXAMPLE 4

The hot-top casting method illustrated in FIG. 5 was carried out.

EXAMPLE 5

The hot-top casting method illustrated in FIG. 6 was carried out.

EXAMPLE 6

The hot-top casting method illustrated in FIG. 7 was carried out (non-forcedly cooled mold).

COMPARATIVE EXAMPLE 1

The hot-top type continuous casting apparatus illustrated in FIG. 1 was used. However, the introduction of pressured gas via the conduit 25 through the header 18 was stopped. Accordingly, during the continuous casting, the annular gap, where pressure was applied, was not formed directly beneath the overhang 23.

COMPARATIVE EXAMPLE 2

The float type continuous casting apparatus illustrated in FIG. 3 was used. However, the core was a cylindrically shaped body of refractory and heat-insulative material (trade name: LUMIBOARD). The core was therefore not forcedly cooled. Lubricating oil was fed through minute slits which were formed through a top part of, and opened on, the outer peripheral surface of the core.

The results of Examples 1 through 6 and Comparative Examples 1 and 2 are given in Table 1.

The casting speed given in Table 1 is the one judged to be optimum depending upon the kind of alloys, cooling conditions and the like. The casting speed was set at this value. Gas air, oxygen-rich argon or nitrogen. During the start of casting period of continuous casting, stability was realized in every one of the inventive examples, without incurring any trouble. However, in the comparative example, such troubles occurred during the start of the casting period, such as break out, non falling of an ingot due to its sticking to the core, and the like. The casting was therefore interrupted. The cast skin of the inner peripheral surface of the ingots were very uniform and smooth in the inventive Examples 1 through 5. In the inventive Example 6, slight periodic remelting skin was observed on parts of the ingots, but the cast skin was considerably improved over the conventional one. However, in the comparative examples, periodic remelting was observed on the cast skin and sticking skin in the form of longitudinal flaws occurred on the cast skin due to contact with the core. These phenomena occurred clearly in every ingot formed in the comparative examples. In addition, these phenomena were more frequent in Comparative Example 2, than Comparative Example 1. In Comparative Example 2, circumferential tear flaws were formed on the cast skin.

Figure 8:
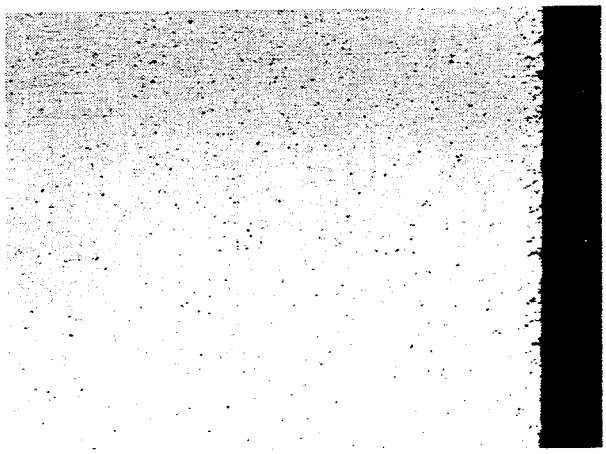
FIG. 8 is a microstructure photograph of the inner peripheral surface layer of a hollow ingot of aluminum alloy (AA 5052) produced by the inventive Example 1.
Figure 9:
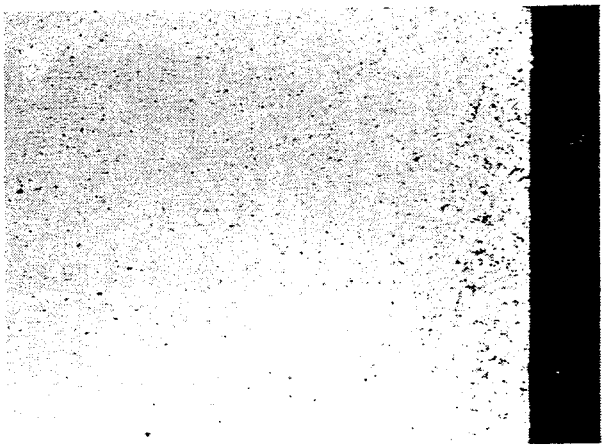
FIG. 9 is a microstructure photograph of the inner peripheral surface layer of a hollow ingot of aluminum alloy (AA 5052) produced by the comparative Example 1.
Figure 10:
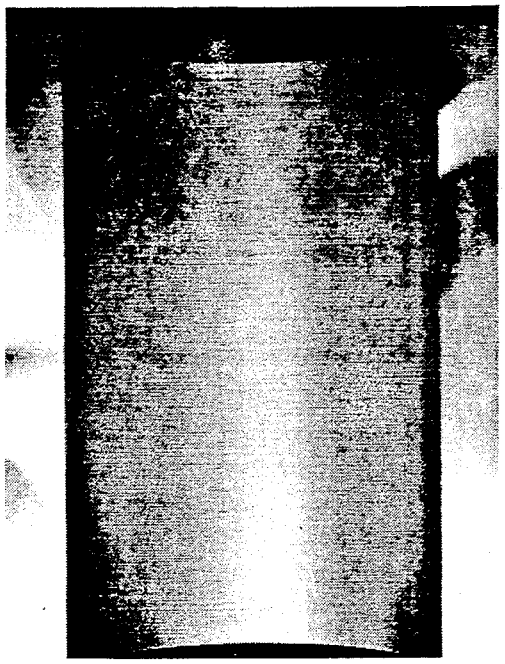
FIG. 10 is a macrostructure photograph of the inner peripheral surface layer of a hollow ingot of aluminum alloy (AA 5052) produced by the inventive Example 1.
Figure 11:
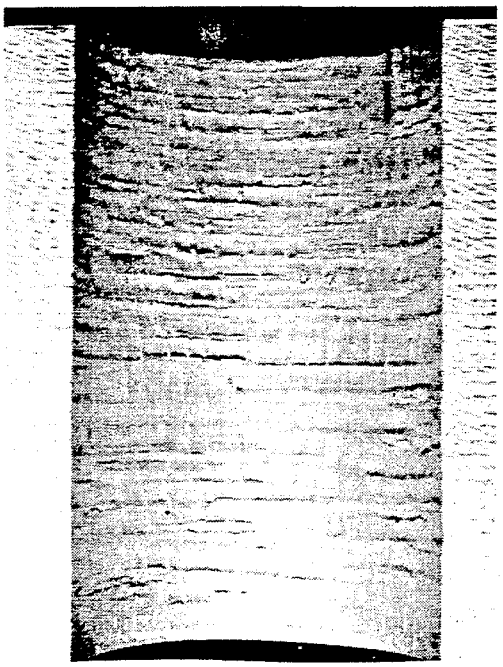
FIG. 11 is a macrostructure photograph of the inner peripheral surface layer of a hollow ingot of aluminum alloy (AA 5052) produced by Comparative Example 1.

The inverse segregation layer directly beneath the cast skin was from 75 to 95 μm thick in the inventive examples but 450 μm and 1500 μm thick in the comparative examples. This difference in thickness of segregation layer is great. The microstructure of the inner peripheral surface of an ingot is shown in FIG. 8 (Example 1) and FIG. 9 (Comparative Example 1). It is readily apparent from these drawings that the thickness of the inverse segregation layer and structural uniformity of the inventive examples are superior to those of the comparative examples.

We claim:

1. A method for continuous casting a hollow ingot, comprising the step of closing, at the casting start, a lower end of an annular space formed between an inner peripheral surface of a forcedly cooled tubular mold and an outer peripheral surface of a forcedly cooled core by a movable bottom block, continuously pouring molten metal into said annular space, holding said molten metal in said annular space, cooling and solidifying said molten metal with said tubular mold and core, thereby forming the hollow ingot, and continuously displacing said movable bottom block thereby withdrawing the solidified metal as a continuous hollow ingot from said tubular mold, characterized by covering, before pouring said molten metal into said annular space, the outer peripheral surface of said core with refractory heat-insulative material, having holes therethrough, for contact with said molten metal and for preventing contact between said molten metal and said core, bringing said molten metal poured into said annular space in the casting start into contact with said refractory heat insulative material, encasing said refractory heat insulative material with said holes therein in metal solidified thereon, withdrawing said bottom block and said refractory heat-insulative material, with said metal solidified thereon and in said holes therethrough from said mold, introducing gas in a downward flow between said outer peripheral surface of said forcedly cooled core and the inner peripheral surface of said molten metal forming said hollow ingot and forming, by said introduced gas, an annular gap surrounding an inner peripheral surface of said hollow metallic molten metal between said inner peripheral surface of said hollow molten metal and said outer peripheral surface of said forcedly cooled core and, with said gas, applying a pressure at said annular gap to said inner peripheral surface of said hollow molten metal outwardly from said core while the molten inner surface of said molten metal solidifies.

2. A method for continuous casting a hollow ingot, comprising the step of closing, at the casting start, a lower end of an annular space formed between an inner peripheral surface of a forcedly cooled tubular mold and an outer peripheral surface of a forcedly cooled core by a movable bottom block, continuously pouring molten metal into said annular space, holding said molten metal in said annular space, cooling and solidifying said molten metal with said tubular mold and core, thereby forming the hollow ingot, and continuously displacing said movable bottom block thereby withdrawing the solidified metal as a continuous hollow ingot from said tubular mold, characterized by covering, before pouring said molten metal into said annular space, the outer peripheral surface of said core, at least one of said inner peripheral surfaces of said tubular mold and the upper surface of said movable bottom block with refractory heat-insulative material having holes therethrough, bringing said molten metal poured into said annular space in the casting start into contact with said refractory heat insulative material, encasing said refractory heat insulative material and said holes therein with metal solidified thereon, withdrawing said bottom block and said refractory heat-insulative material, with said metal solidified thereon and said holes therein from said mold, together with said hollow ingot being withdrawn, introducing gas in a downward flow between said outer peripheral surface of said forcedly cooled core and the inner peripheral surface of said molten metal forming said hollow ingot and forming, by said introduced gas, an annular gap surrounding an inner peripheral surface of said hollow metallic molten metal between said inner peripheral surface of said hollow molten metal and said outer peripheral surface of said forcedly cooled core and, with said gas, applying a pressure at said annular gap to said inner peripheral surface of said hollow molten metal outwardly from said core while the molten inner surface of said molten metal solidifies.

3. A method for continuous casting a hollow ingot, comprising the step of closing, at the casting start, a lower end of an annular space formed between an inner peripheral surface of a forcedly cooled tubular mold and an outer peripheral surface of a forcedly cooled core by a movable bottom block, continuously pouring molten metal into said annular space, holding said molten metal in said annular space, cooling and solidifying said molten metal with said tubular mold and core, thereby forming the hollow ingot, and continuously displacing said movable bottom block thereby withdrawing the solidified metal as a continuous hollow ingot from said tubular mold, characterized by covering, before pouring said molten metal into said annular space, said tubular mold and the outer peripheral surface of said core with refractory heat-insulative material, having grooves on an outer edge thereof, for contact with said molten metal and for preventing contact between said molten metal and said core, bringing said molten metal poured into said annular space in the casting start into contact with said refractory heat insulative material, encasing said refractory heat insulative material and said grooves on said outer edge thereof with metal solidified thereon and in said grooves in said refractory heat insulating material, withdrawing said bottom block and said refractory heat-insulative material, with said metal solidified thereon and in said grooves from said mold, introducing gas in a downward flow between said outer peripheral surface of said forcedly cooled core and the inner peripheral surface of said molten metal forming said hollow ingot and forming, by said introduced gas, an annular gap surrounding an inner peripheral surface of said hollow metallic molten metal and said outer peripheral surface of said forcedly cooled core and, with said gas, applying a pressure at said annular gap to said inner peripheral surface of said hollow molten metal outwardly from said core while the molten inner surface of said molten metal solidifies.

4. A method for continuously casting according to claim 3, wherein said refractory heat-insulative material is provided with lugs of material resistant against erosion by said molten metal and protrude beyond an inner surface of said materials and encased with said metal solidified thereon and withdrawn together with said hollow ingot.

5. A method for continuous casting a hollow ingot, comprising the step of closing, at the casting start, a lower end of an annular space formed between an inner peripheral surface of a forcedly cooled tubular mold and an outer peripheral surface of a forcedly cooled core by a movable bottom block, continuously pouring molten metal into said annular space, holding said molten metal in said annular space, cooling and solidifying said molten metal with said tubular mold and core, thereby forming the hollow ingot, and continuously displacing said movable bottom block thereby withdrawing the solidified metal as a continuous hollow ingot from said tubular mold, characterized by covering, before pouring said molten metal into said annular space, at least one of said inner peripheral surfaces of said tubular mold, the upper surface of said movable bottom block and the outer peripheral surface of said core with refractory heat-insulative material, having grooves on an outer edge thereof, for contact with said molten metal and for preventing contact between said molten metal and said core, bringing said molten metal poured into said annular space in the casting start into contact with said refractory heat insulative material, encasing said refractory heat insulative material and said grooves on said outer edge thereof with metal solidified thereon and in said grooves in said refractory heat insulating material, withdrawing said bottom block and said refractory heat-insulative material, with said metal solidified thereon and in said grooves from said mold, introducing as in a downward flow between said outer peripheral surface of said forcedly cooled core and the inner peripheral surface of said molten metal forming said hollow ingot and forming, by said introduced gas, an annular gap surrounding an inner peripheral surface of said hollow metallic molten metal between said inner peripheral surface of said hollow molten metal and said outer peripheral surface of said forcedly cooled core and, with said gas, applying a pressure at said annular gap to said inner peripheral surface of said hollow molten metal outwardly from said core while the molten inner surface of said molten metal solidifies.

6. A continuous casting apparatus for casting a hollow ingot comprising a forcedly cooled tubular mold, a forcedly cooled tapered core held inside said tubular mold and a movable bottom starter block, characterized by further comprising: an overhang protruding outwardly above an outer peripheral surface of said core and in contact with molten metal during casting, a refractory heat-insulative material for contacting and covering said tapered core for contact with said movable bottom starter block and preventing contact between said molten metal and said core at the start of said casting before said starter block is removed; and apertures which end on the outer peripheral surface of said core adjacent said overhang and communicate with a gas source and means at said apertures for introducing gas from said gas source in a downward flow between said peripheral surface of said tapered core and the inner peripheral surface of said molten metal for applying pressure to said molten inner surface outwardly from said core while molten metal is poured into the space between said tubular mold and tapered core, inner and outer tubular surfaces of said molten metal solidifies and said ingot is withdrawn from said mold, said apertures being slits formed between an upper surface of said core and a lower surface of a refractory heat-insulative body.

7. A continuous casting apparatus according to claim 6, wherein said movable bottom block is connected to a liftable table via a carrier which comprises legs for carrying the movable bottom block and at least one slope means for flowing down therealong cooling water from the core and molten metal leaked through the inner peripheral surface of the hollow ingot, and, further, said legs are connected to a first part of said liftable table by the lower ends thereof and carry said movable bottom block at parts of their upper ends, and, said slope means are located on said liftable table inside said legs, thereby directing said slope surface means between the top and bottom of said bottom block on said liftable table.

* * * * *